US011005200B2

(12) United States Patent
Ashibu

(10) Patent No.: US 11,005,200 B2
(45) Date of Patent: May 11, 2021

(54) CONNECTOR ASSEMBLY AND CONNECTOR

(71) Applicant: JAPAN AVIATION ELECTRONICS INDUSTRY, LIMITED, Tokyo (JP)

(72) Inventor: Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/512,108

(22) Filed: Jul. 15, 2019

(65) Prior Publication Data

US 2020/0067217 A1 Feb. 27, 2020

(30) Foreign Application Priority Data

Aug. 24, 2018 (JP) ..... JP2018-157644

(51) Int. Cl.
*H01R 12/71* (2011.01)
*H01R 13/405* (2006.01)

(52) U.S. Cl.
CPC ..... *H01R 12/716* (2013.01); *H01R 13/405* (2013.01)

(58) Field of Classification Search
CPC .... H01R 12/707; H01R 12/73; H01R 12/716; H01R 12/7094; H01R 13/405
USPC ..... 439/74, 66
See application file for complete search history.

(56) References Cited

U.S. PATENT DOCUMENTS 7,344,387 B2 3/2008 Shiroyama
7,637,786 B2 12/2009 Hoshino et al.
8,092,232 B2 1/2012 Takeuchi
8,986,027 B2 * 3/2015 Nishimura ..... H01R 12/707 439/181

(Continued)

FOREIGN PATENT DOCUMENTS

CN 101777710 A 7/2010
CN 104112946 A 10/2014

(Continued)

OTHER PUBLICATIONS

Chinese Office Action (and English language translation thereof) dated Sep. 22, 2020 issued in counterpart Chinese Application No. 201910664013.1.

(Continued)

*Primary Examiner* — Abdullah A Riyami
*Assistant Examiner* — Marcus E Harcum
(74) *Attorney, Agent, or Firm* — Holtz, Holtz & Volek PC

(57) ABSTRACT

A connector assembly comprises a first connector and a second connector. The first connector comprises a first insulator and a first metal member. The first metal member has a first metal plane. The second connector comprises a second insulator and a second metal member. The second insulator has at least one insulating plane. The second metal member has a second metal plane. The first metal plane, at least in part, faces each of the second metal plane and the at least one insulating plane in a first direction under a mated state where the first connector and the second connector are mated with each other. A distance from the first metal plane to the second metal plane in the first direction is shorter than a distance from the first metal plane to the at least one insulating plane in the first direction under the mated state.

17 Claims, 17 Drawing Sheets

(56) References Cited

U.S. PATENT DOCUMENTS

| | | | | |
|---|---|---|---|---|
| 9,196,984 | B2 | 11/2015 | Ishida et al. | |
| 9,225,086 | B2 | 12/2015 | Takeuchi et al. | |
| 9,312,617 | B2 | 4/2016 | Hirata | |
| 9,362,637 | B2 * | 6/2016 | Hasegawa | H01R 12/7076 |
| 9,666,963 | B2 * | 5/2017 | He | H01R 12/7088 |
| 10,333,239 | B2 * | 6/2019 | Ashibu | H01R 12/716 |
| 10,396,484 | B2 * | 8/2019 | Chen | H01R 12/7088 |
| 10,566,735 | B2 * | 2/2020 | Ashibu | H01R 12/73 |
| 2007/0281519 | A1 | 12/2007 | Shiroyama | |
| 2009/0176386 | A1 * | 7/2009 | Wu | H01R 12/716 439/74 |
| 2009/0264075 | A1 * | 10/2009 | Lee | H04M 1/7253 455/41.2 |
| 2009/0280658 | A1 * | 11/2009 | Hoshino | H01R 12/716 439/66 |
| 2010/0068900 | A1 * | 3/2010 | Wu | H01R 12/716 439/74 |
| 2011/0263140 | A1 * | 10/2011 | Sato | H01R 12/7052 439/74 |
| 2013/0330943 | A1 * | 12/2013 | Sasaki | H01R 12/716 439/74 |
| 2015/0214643 | A1 | 7/2015 | Lee et al. | |
| 2015/0270641 | A1 * | 9/2015 | Omodachi | H01R 13/629 439/374 |
| 2015/0303597 | A1 | 10/2015 | He | |
| 2016/0315430 | A1 | 10/2016 | Takeuchi et al. | |
| 2017/0098900 | A1 * | 4/2017 | Kobuchi | H01R 13/405 |
| 2018/0175561 | A1 * | 6/2018 | Chen | H01R 12/52 |
| 2018/0198241 | A1 * | 7/2018 | Ooi | H01R 13/6597 |
| 2018/0205165 | A1 * | 7/2018 | Hoshiba | H01R 12/716 |
| 2018/0248287 | A1 * | 8/2018 | Ashibu | H01R 12/716 |
| 2018/0277972 | A1 | 9/2018 | Takeuchi et al. | |
| 2019/0190209 | A1 * | 6/2019 | Horino | H01R 12/716 |
| 2019/0348780 | A1 * | 11/2019 | Kitazawa | H01R 13/631 |
| 2019/0348784 | A1 * | 11/2019 | Yufu | H01R 13/6581 |
| 2019/0363467 | A1 * | 11/2019 | Ko | H01R 27/00 |
| 2019/0372250 | A1 | 12/2019 | Takeuchi et al. | |
| 2020/0044374 | A1 * | 2/2020 | Ishida | H01R 12/721 |
| 2020/0067227 | A1 * | 2/2020 | Gondo | H01R 12/716 |

FOREIGN PATENT DOCUMENTS

| | | | |
|---|---|---|---|
| CN | 103155292 | B | 1/2016 |
| CN | 205666371 | U | 10/2016 |
| CN | 206893923 | U | 1/2018 |
| JP | 2006344418 | A | 12/2006 |
| JP | 2007328961 | A | 12/2007 |
| JP | 2012069263 | A | 4/2012 |
| JP | 2015207557 | A | 11/2015 |
| KR | 20170136423 | A | 12/2017 |
| TW | I360265 | B | 3/2012 |

OTHER PUBLICATIONS

Taiwanese Office Action (and English language translation thereof) dated May 27, 2020 issued in counterpart Taiwanese Application No. 108125053.

Korean Office Action (and English language translation thereof) dated May 26, 2020 issued in counterpart Korean Application No. 10-2019-0088117.

* cited by examiner

CONNECTOR ASSEMBLY AND CONNECTOR

CROSS REFERENCE TO RELATED APPLICATIONS

This application is based on and claims priority under 35 U.S.C. § 119 to Japanese Patent Application No. JP2018-157644 filed Aug. 24, 2018, the contents of which are incorporated herein in their entireties by reference.

BACKGROUND OF THE INVENTION

This invention relates to a connector assembly and a connector.

Referring to FIGS. 33 and 34, JPA2015-207557 (Patent Document 1) discloses a connector assembly which comprises a first connector 950 and a second connector 910. The first connector 950 is mateable with and removable from the second connector 910 along a Z-direction. The first connector 950 comprises a first insulator 952 and first metal members 956. Each of the first metal members 956 is held by the first insulator 952. The second connector 910 comprises a second insulator 912 and second metal members 916. Each of the second metal members 916 is held by the second insulator 912. The first connector 950 is used in a state where the first connector 950 is mounted on a circuit board (not shown), while the second connector 910 is used in a state where the second connector 910 is mounted on another circuit board (not shown). In other words, the first connector 950 and the second connector 910 form a board-to-board connector assembly.

In the connector assembly of Patent Document 1, an operator cannot recognize whether or not the first connector 950 and the second connector 910 arrive at their regular mating positions when the first connector 950 and the second connector 910 are mated with each other.

SUMMARY OF THE INVENTION

It is therefore an object of the present invention to provide a connector assembly having a structure which enables an operator to easily and reliably recognize arrivals of a first connector and a second connector at their regular mating positions.

One aspect of the present invention provides a connector assembly comprising a first connector and a second connector. The first connector is mateable with and removable from the second connector along a first direction. The first connector comprises a first insulator and a first metal member. The first metal member is held by the first insulator. The first metal member has a first metal plane. The second connector comprises a second insulator and a second metal member. The second insulator has at least one insulating plane. The second metal member is held by the second insulator. The second metal member has a second metal plane. The second metal plane is arranged adjacent to the at least one insulating plane in a second direction perpendicular to the first direction. The first metal plane, at least in part, faces each of the second metal plane and the at least one insulating plane in the first direction under a mated state where the first connector and the second connector are mated with each other. A distance from the first metal plane to the second metal plane in the first direction is shorter than a distance from the first metal plane to the at least one insulating plane in the first direction under the mated state.

The connector assembly of the present invention has the features as follows: the first metal plane, at least in part, faces each of the second metal plane and the at least one insulating plane in the first direction under the mated state where the first connector and the second connector are mated with each other; and the distance from the first metal plane to the second metal plane in the first direction is shorter than the distance from the first metal plane to the at least one insulating plane in the first direction under the mated state where the first connector and the second connector are mated with each other. Accordingly, the connector assembly of the present invention is configured so that the first metal plane securely makes surface-to-surface abutment with the second metal plane when the first connector and the second connector are mated with each other. Thus, when the mating of the first connector with the second connector has been completed upon the first connector and the second connector being mated with each other, the first metal plane and the second metal plane abut against each other to produce a rather loud metallic sound. In other words, the connector assembly has an effect that the rather loud metallic sound is produced when the mating of the first connector with the second connector has been completed. Therefore, an operator can easily and reliably recognize arrivals of the first connector and the second connector at their regular mating positions by hearing the metallic sound. In particular, the aforementioned effect is especially beneficial when the connector assembly of the present invention is used as a board-to-board connector assembly.

An appreciation of the objectives of the present invention and a more complete understanding of its structure may be had by studying the following description of the preferred embodiment and by referring to the accompanying drawings.

Figure 1:
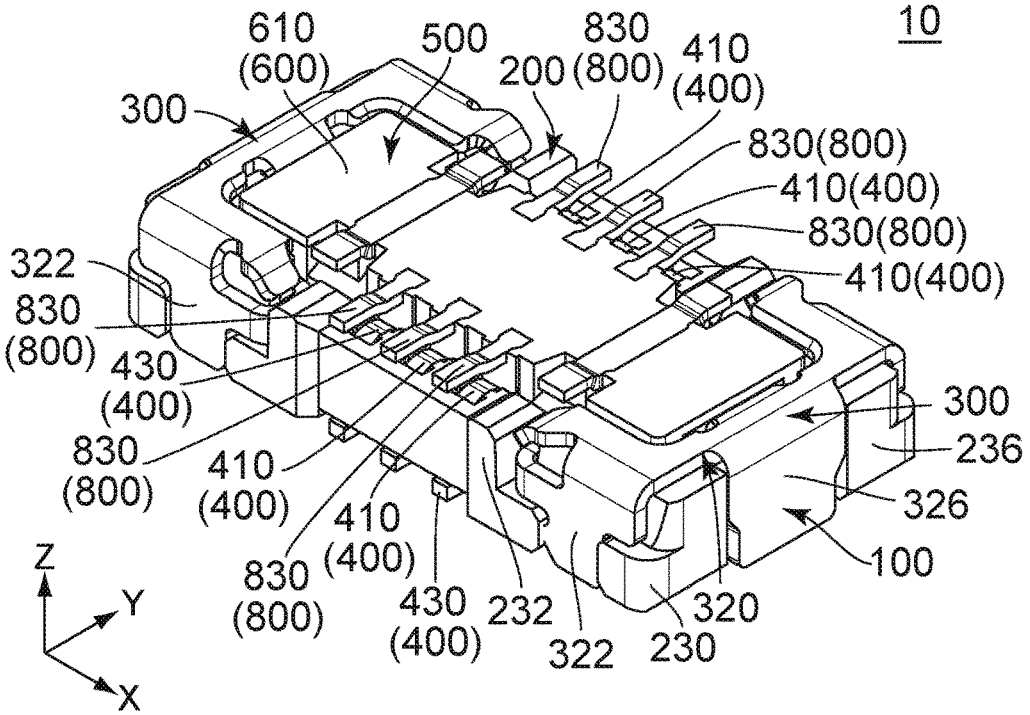
FIG. 1 is an upper perspective view showing a connector assembly according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIG. 1, a connector assembly 10 according to a first embodiment of the present invention comprises a first connector 500 and a second connector 100.

Figure 4:
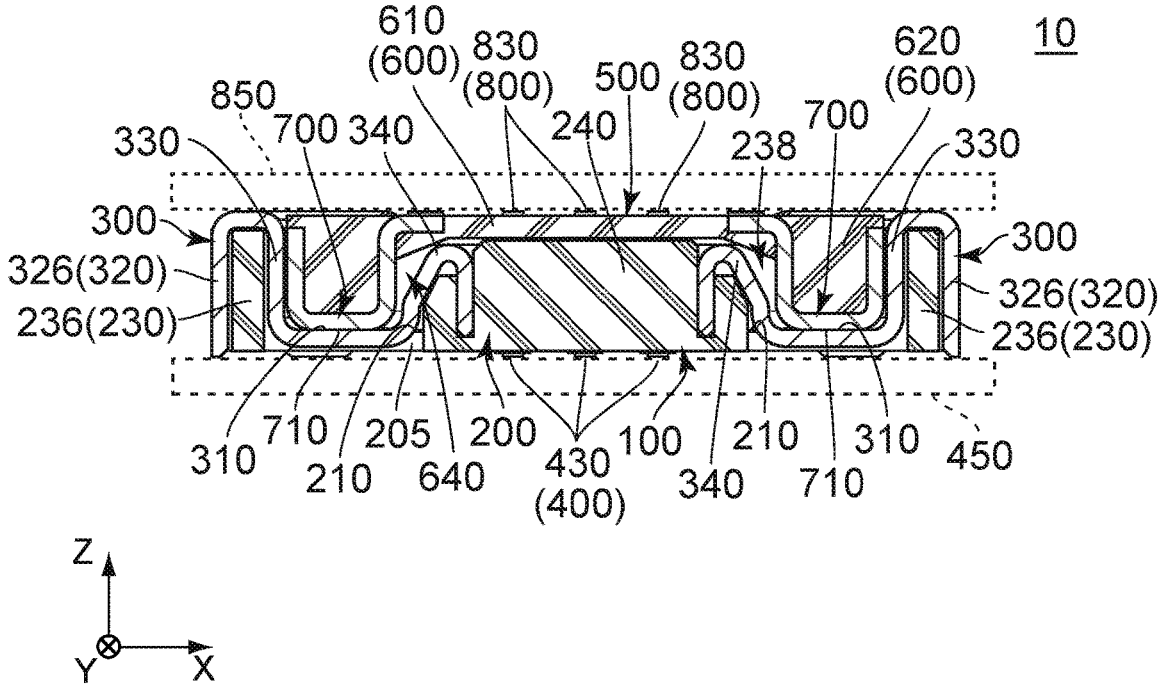
FIG. 4 is a cross-sectional view showing the connector assembly of FIG. 3, taken along line A-A. In the figure, a first circuit board and a second circuit board are illustrated by dotted lines.
Figure 5:
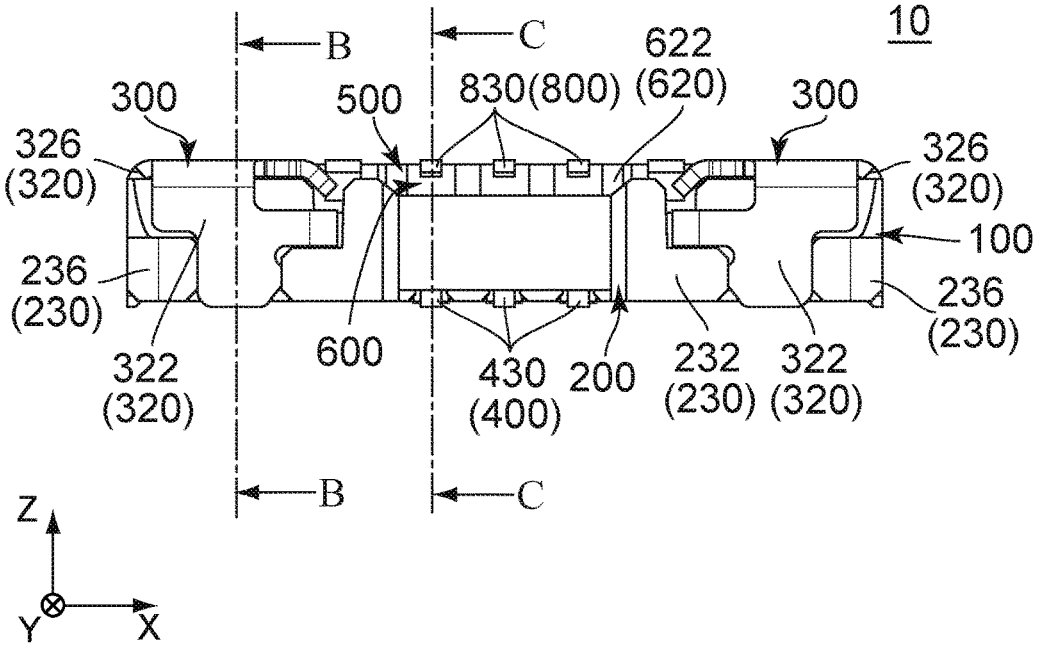
FIG. 5 is a side view showing the connector assembly of FIG. 1.

Referring to FIGS. 1 and 4, the first connector 500 according to the present embodiment is mateable with and removable from the second connector 100 along a first direction. In the present embodiment, the first direction is an up-down direction. In the figure, the up-down direction is shown as a Z-direction. Specifically, it is assumed that upward is a positive Z-direction while downward is a negative Z-direction.

Figure 11:
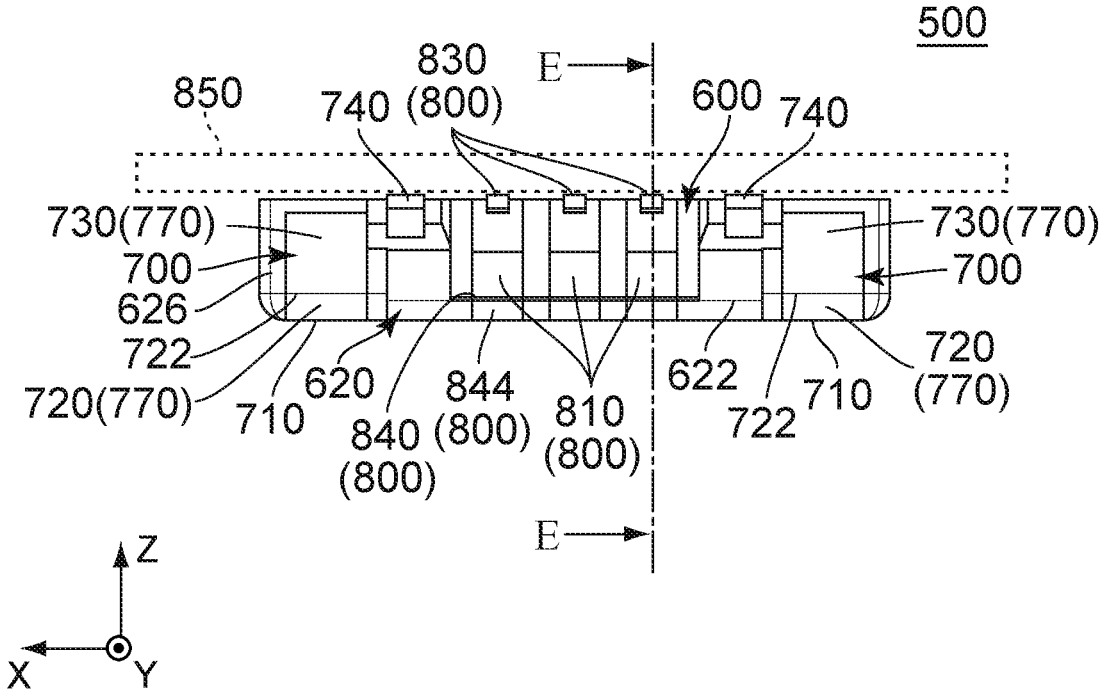
FIG. 11 is a side view showing the first connector of FIG. 8. In the figure, the first circuit board is illustrated by dotted line.

As shown in FIG. 11, the first connector 500 of the present embodiment is fixed on a first circuit board 850 when used.

Figure 8:
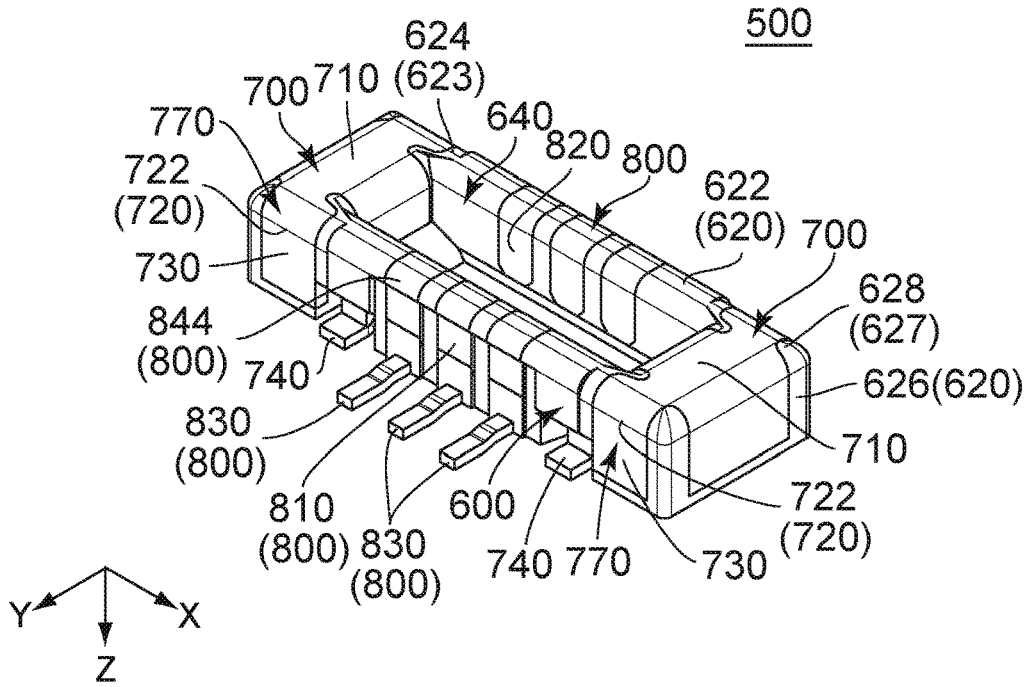
FIG. 8 is a lower perspective view showing the first connector which is included in the connector assembly of FIG. 1.

As shown in FIG. 8, the first connector 500 of the present embodiment comprises a first insulator 600, two first metal members 700 and a plurality of first terminals 800. However, the present invention is not limited thereto. The number of the first terminal 800 may be one. In other words, the first connector 500 may comprise at least one first terminal 800. In addition, the first connector 500 may be modified, provided that the first connector 500 comprises the first insulator 600 and the first metal member 700. In other words, the first connector 500 may not comprise the first terminal 800.

Figure 9:
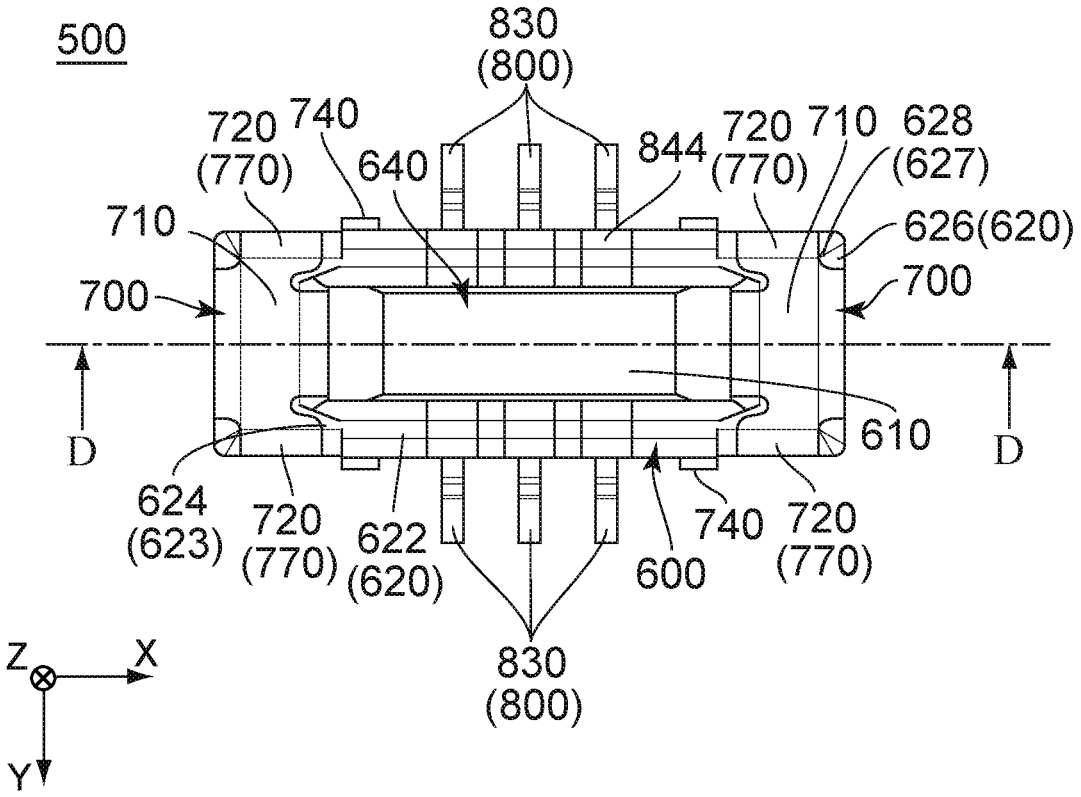
FIG. 9 is a bottom view showing the first connector of FIG. 8.

Referring to FIG. 9, the first insulator 600 of the present embodiment is made of resin. Specifically, the first insulator 600 has an upper surface portion 610, a first peripheral portion 620 and an island-like portion accommodation portion 640.

Figure 10:
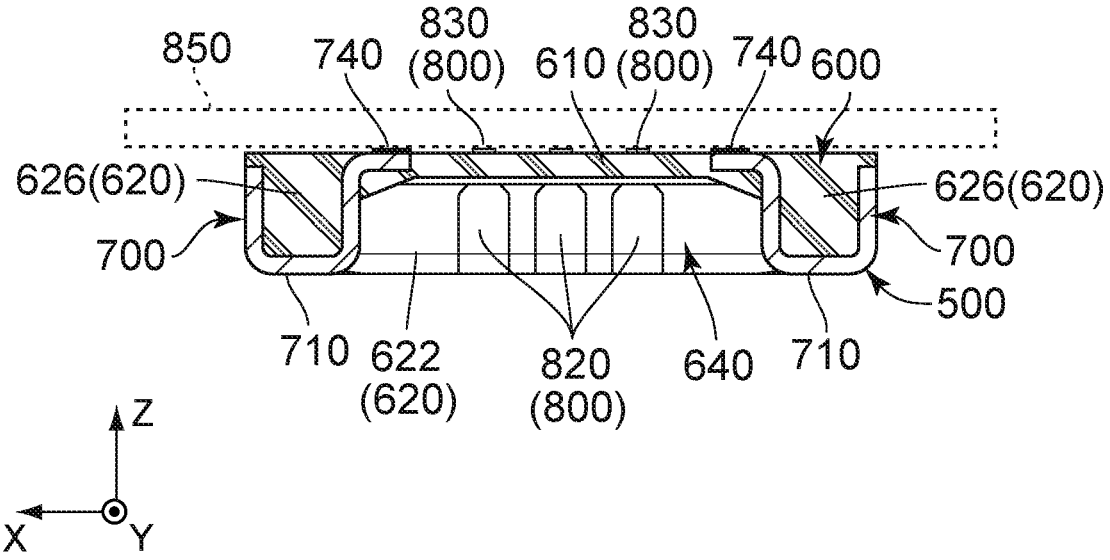
FIG. 10 is a cross-sectional view showing the first connector of FIG. 9, taken along line D-D. In the figure, the first circuit board is illustrated by dotted line.
Figure 12:
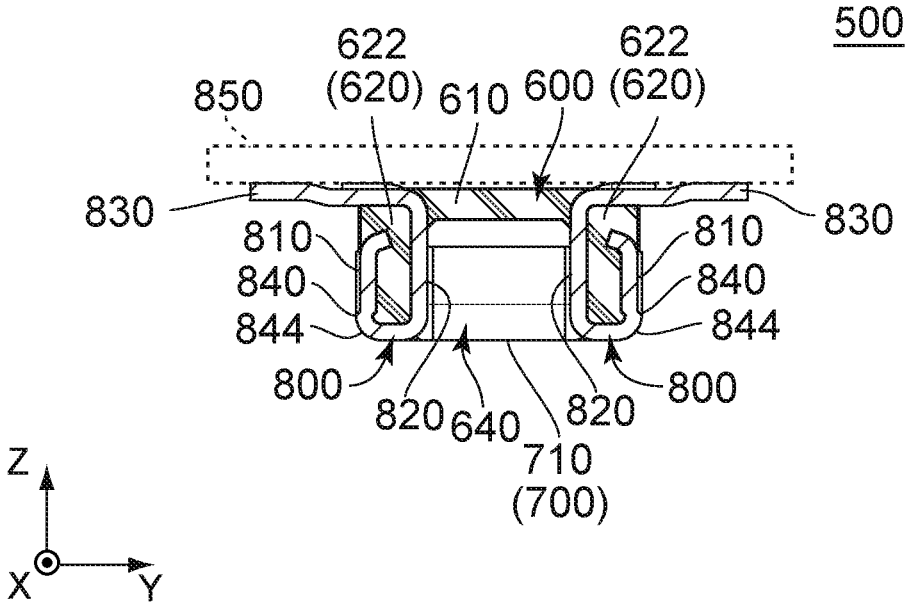
FIG. 12 is a cross-sectional view showing the first connector of FIG. 11, taken along line E-E. In the figure, the first circuit board is illustrated by dotted line.

As shown in FIGS. 9, 10 and 12, the upper surface portion 610 of the present embodiment has a plate-like shape perpendicular to the up-down direction. The upper surface portion 610 defines an upper end of the first insulator 600.

As shown in FIG. 9, the first peripheral portion 620 of the present embodiment has a rectangular outer periphery when viewed along the up-down direction. The first peripheral portion 620 has two first longer walls 622 and two first shorter walls 626.

As shown in FIGS. 9 and 12, the first longer walls 622 of the present embodiment face each other in a second direction. In the present embodiment, the second direction is a Y-direction. An upper end of the first longer wall 622 is coupled with the upper surface portion 610. The first longer wall 622 has adjacent portions 623 which are arranged adjacent to the first metal members 700, respectively.

As shown in FIGS. 9 and 10, the first shorter walls 626 face each other in a third direction. In the present embodiment, the third direction is an X-direction. An upper end of the first shorter wall 626 is coupled with the upper surface portion 610. Opposite ends of the first shorter wall 626 in the second direction are coupled with the first longer walls 622, respectively. A lower end of the first shorter wall 626 is positioned at a position same as a position of a lower end of the first longer wall 622 in the up-down direction. The first shorter wall 626 has an adjacent portion 627 which is arranged adjacent to the first metal member 700.

As shown in FIGS. 9, 10 and 12, the island-like portion accommodation portion 640 of the present embodiment is a recess which is opened at its lower end in the up-down direction. In other words, the island-like portion accommodation portion 640 is recessed upward. The upper surface portion 610 defines an upper end of the island-like portion accommodation portion 640. The island-like portion accommodation portion 640 is surrounded by the first peripheral portion 620 in a plane perpendicular to the up-down direction. In the present embodiment, the plane perpendicular to the up-down direction is an XY-plane.

As shown in FIGS. 8 to 12, each of the first metal members 700 of the present embodiment is held by the first insulator 600. More specifically, the first metal members 700 are held by opposite ends, respectively, of the first insulator 600 in the third direction.

Referring to FIG. 8, each of the first metal members 700 of the present embodiment is made of metal. Specifically, each of the first metal members 700 has a first metal plane 710, first additional members 770 and first metal member fixed portions 740. Each of the first additional members 770 is formed as a part of the first metal member 700.

As shown in FIGS. 9, 10 and 12, the first metal plane 710 of the present embodiment is a plane perpendicular to the first direction, or to the up-down direction. The first metal plane 710 is positioned at the lower end of the first longer wall 622 of the first peripheral portion 620 of the first insulator 600. The first metal plane 710 is positioned at the lower end of the first shorter wall 626 of the first peripheral portion 620 of the first insulator 600.

The adjacent portion 623 of the first insulator 600 has a portion 624, which is in contact with the first metal plane 710. The first metal plane 710 is positioned at a position same as a position of a lower end of the portion 624 in the up-down direction. The adjacent portion 627 of the first insulator 600 has a portion 628, which is in contact with the first metal plane 710. The first metal plane 710 is positioned at a position same as a position of a lower end of the portion 628 in the up-down direction. However, the present invention is not limited thereto. The first metal plane 710 may be positioned at a position different from the position of the lower end of the portion 624 of the adjacent portion 623 of the first insulator 600 in the up-down direction. Similarly, the first metal plane 710 may be positioned at a position different from the position of the lower end of the portion 628 of the adjacent portion 627 of the first insulator 600 in the up-down direction.

As shown in FIG. 11, each of the first additional members 770 has a coupling portion 720 and a side surface portion 730.

Figure 6:
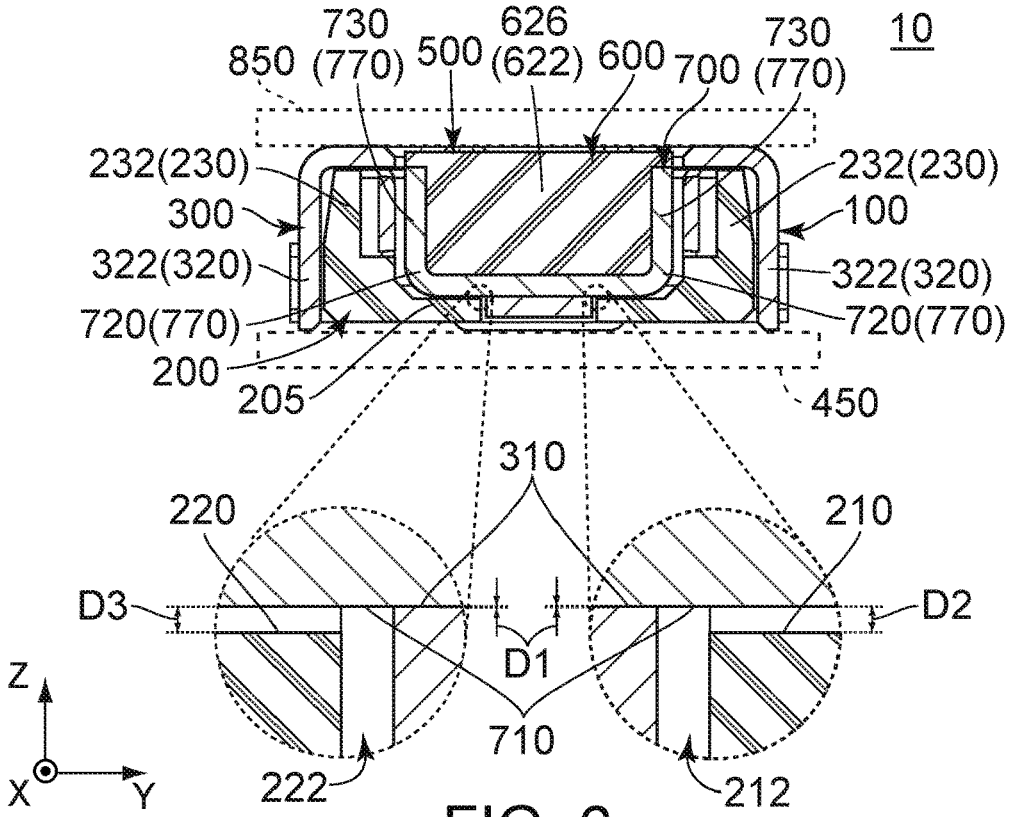
FIG. 6 is a cross-sectional view showing the connector assembly of FIG. 5, taken along line B-B. In the figure, parts of the connector assembly are illustrated enlarged, and the first circuit board and the second circuit board are illustrated by dotted lines.

As shown in FIG. 6, the coupling portion 720 of the present embodiment has a rounded cross-section which is perpendicular to the third direction. In other words, an outer surface of the coupling portion 720 is a rounded surface. The coupling portion 720 couples the first metal plane 710 with the side surface portion 730. As shown in FIG. 11, the coupling portion 720 has an end portion 722. The end portion 722 is an upper end of the coupling portion 720.

As understood from FIGS. 6 and 8, the side surface portion 730 of the present embodiment has a plate-like shape perpendicular to the second direction. The side surface portion 730 is positioned at an outer end of the first longer wall 622 of the first peripheral portion 620 of the first insulator 600 in the second direction.

Referring to FIGS. 10 and 11, each of the first metal member fixed portions 740 of the present embodiment is soldered to a circuit trace (not shown) of the first circuit board 850 when the first connector 500 is fixed on the first circuit board 850. As shown in FIG. 9, the first metal member fixed portion 740 extends outward in the second direction from the first longer wall 622 of the first peripheral portion 620 of the first insulator 600. As shown in FIG. 10, in the up-down direction, an outer end of the first metal member fixed portion 740 is positioned outward of an outer end of the upper surface portion 610 of the first insulator 600. Specifically, in the up-down direction, an upper end of the first metal member fixed portion 740 is positioned above an upper end of the upper surface portion 610 of the first insulator 600.

As shown in FIGS. 8 to 12, each of the first terminals 800 of the present embodiment is held by the first insulator 600. More specifically, the first terminal 800 is held by the first longer wall 622 of the first peripheral portion 620 of the first insulator 600. In other words, the first insulator 600 holds the plurality of first terminals 800.

Referring to FIG. 12, each of the first terminals 800 of the present embodiment is made of conductor. Specifically, each of the first terminals 800 has a first outer contact portion 810, a first inner contact portion 820, a first fixed portion 830, a step portion 840 and a bent portion 844.

As shown in FIGS. 8 and 12, the first outer contact portion 810 of the present embodiment is exposed on an outer surface of the first longer wall 622 of the first peripheral portion 620 of the first insulator 600 in the second direction.

As shown in FIGS. 10 and 12, the first inner contact portion 820 of the present embodiment is exposed on an inner surface of the first longer wall 622 of the first peripheral portion 620 of the first insulator 600 in the second direction. Specifically, the first inner contact portion 820 is exposed in the island-like portion accommodation portion 640 of the first insulator 600. The first inner contact portion 820 is positioned inward of the first outer contact portion 810 in the second direction.

Referring to FIG. 12, the first fixed portion 830 of the present embodiment is soldered to a circuit trace (not shown) of the first circuit board 850 when the first connector 500 is fixed on the first circuit board 850. The first fixed portion 830 extends outward in the second direction from the first longer wall 622 of the first peripheral portion 620 of the first insulator 600. In the up-down direction, an outer end of the first fixed portion 830 is positioned outward of the outer end of the upper surface portion 610 of the first insulator 600. Specifically, in the up-down direction, an upper end of the first fixed portion 830 is positioned above the upper end of the upper surface portion 610 of the first insulator 600.

As shown in FIG. 12, the step portion 840 of the present embodiment extends outward in the second direction from the first outer contact portion 810. An inner end of the step portion 840 in the second direction is coupled with the first outer contact portion 810. An outer end of the step portion 840 in the second direction is the outermost end of the first terminal 800 in the second direction.

As shown in FIG. 12, the bent portion 844 of the present embodiment extends downward in the up-down direction from the step portion 840. The bent portion 844 extends downward in the up-down direction from a part of the step portion 840, which is the outer end of the step portion 840 in the second direction. Specifically, an upper end of the bent portion 844 is the outer end of the step portion 840 in the second direction.

Figure 15:
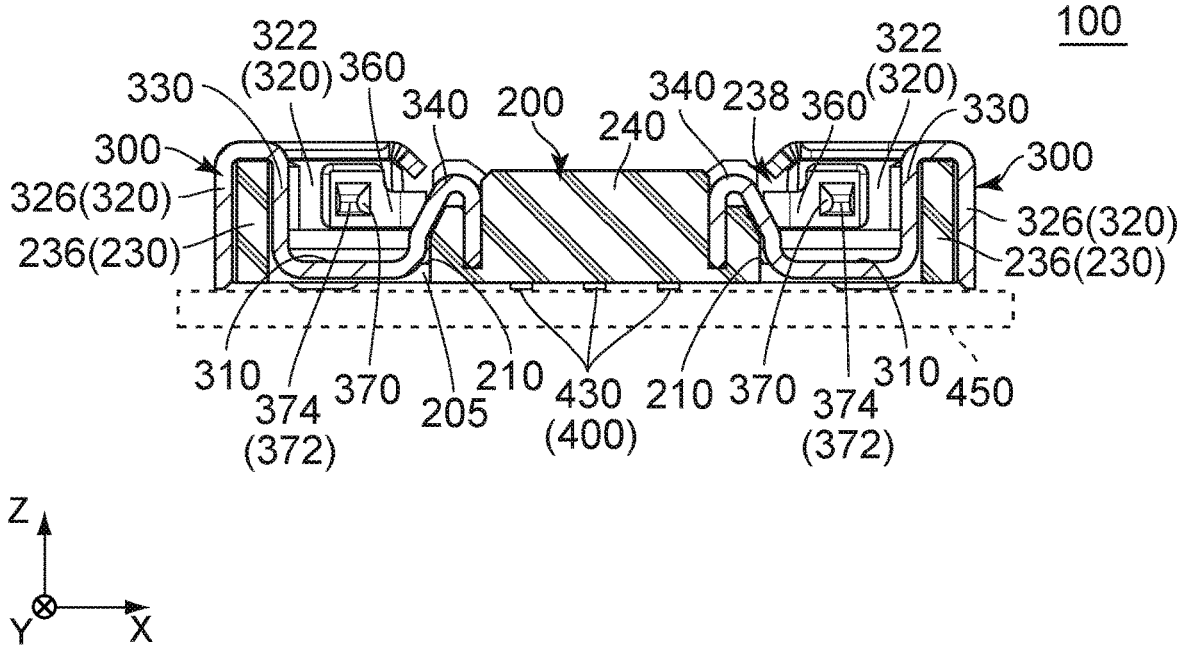
FIG. 15 is a cross-sectional view showing the second connector of FIG. 14, taken along line F-F. In the figure, the second circuit board is illustrated by dotted line.
Figure 16:
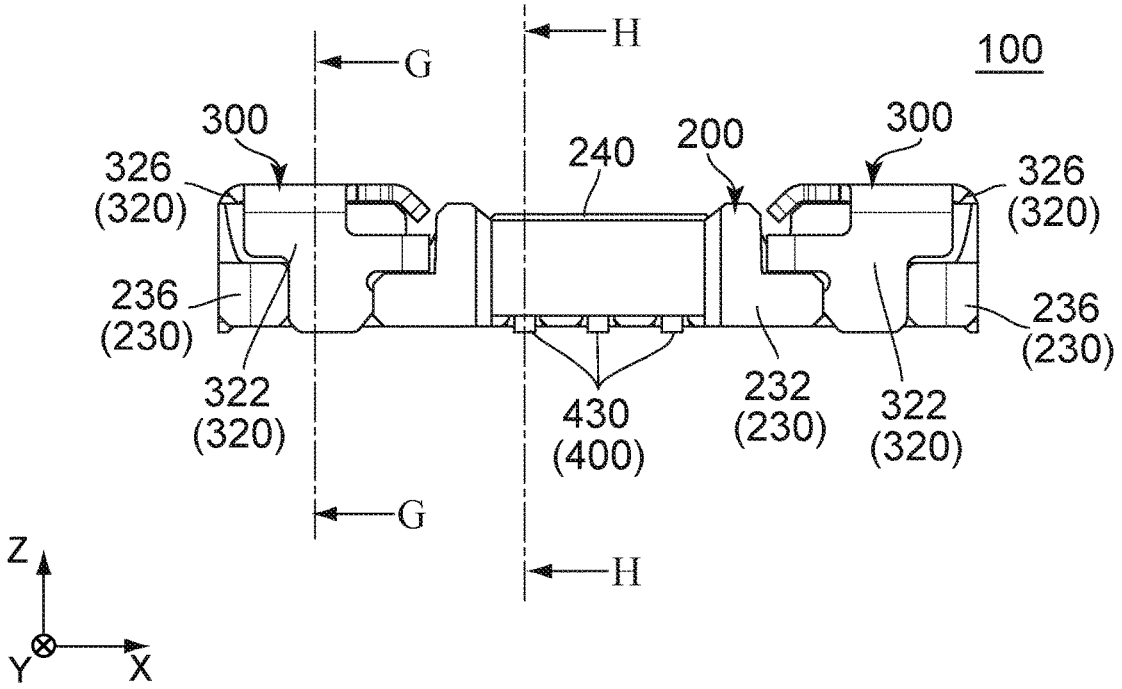
FIG. 16 is a side view showing the second connector of FIG. 13.

As shown in FIG. 15, the second connector 100 according to the present embodiment is fixed on a second circuit board 450 when used, wherein the second circuit board 450 is different from the first circuit board 850.

Figure 13:
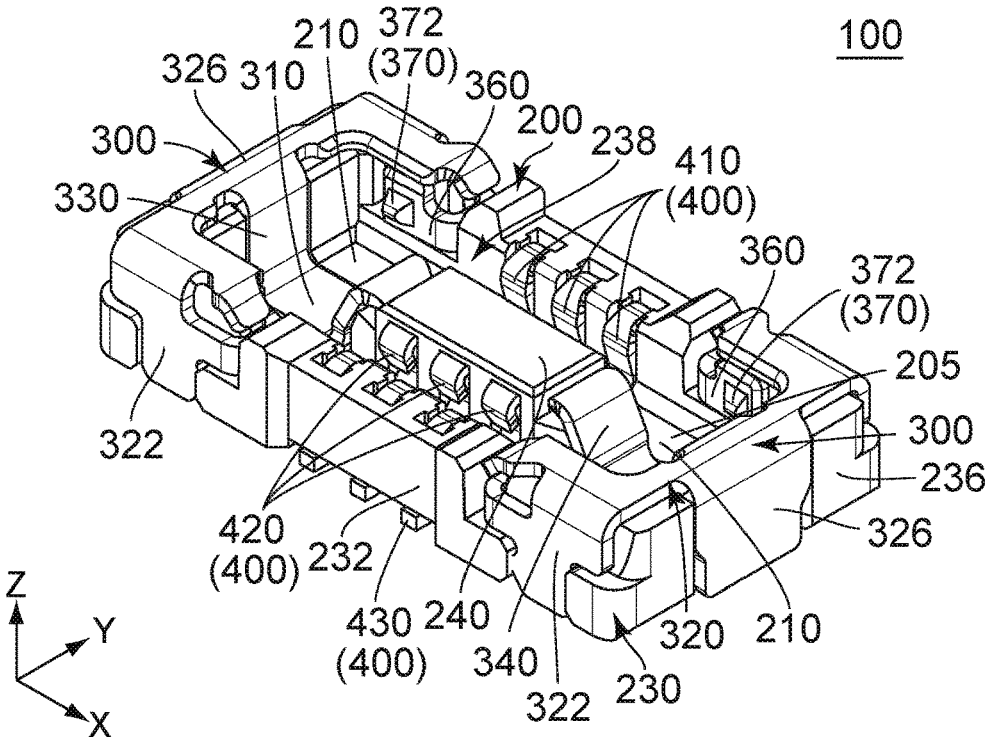
FIG. 13 is an upper perspective view showing a second connector which is included in the connector assembly of FIG. 1.

As shown in FIG. 13, the second connector 100 according to the present embodiment comprises a second insulator 200, two second metal members 300 and a plurality of second terminals 400. However, the present invention is not limited thereto. The number of the second terminal 400 may be one. In other words, the second connector 100 may comprise at least one second terminal 400. In addition, the second connector 100 may be modified, provided that the second connector 100 comprises the second insulator 200 and the second metal member 300. In other words, the second connector 100 may not comprise the second terminal 400.

Figure 14:
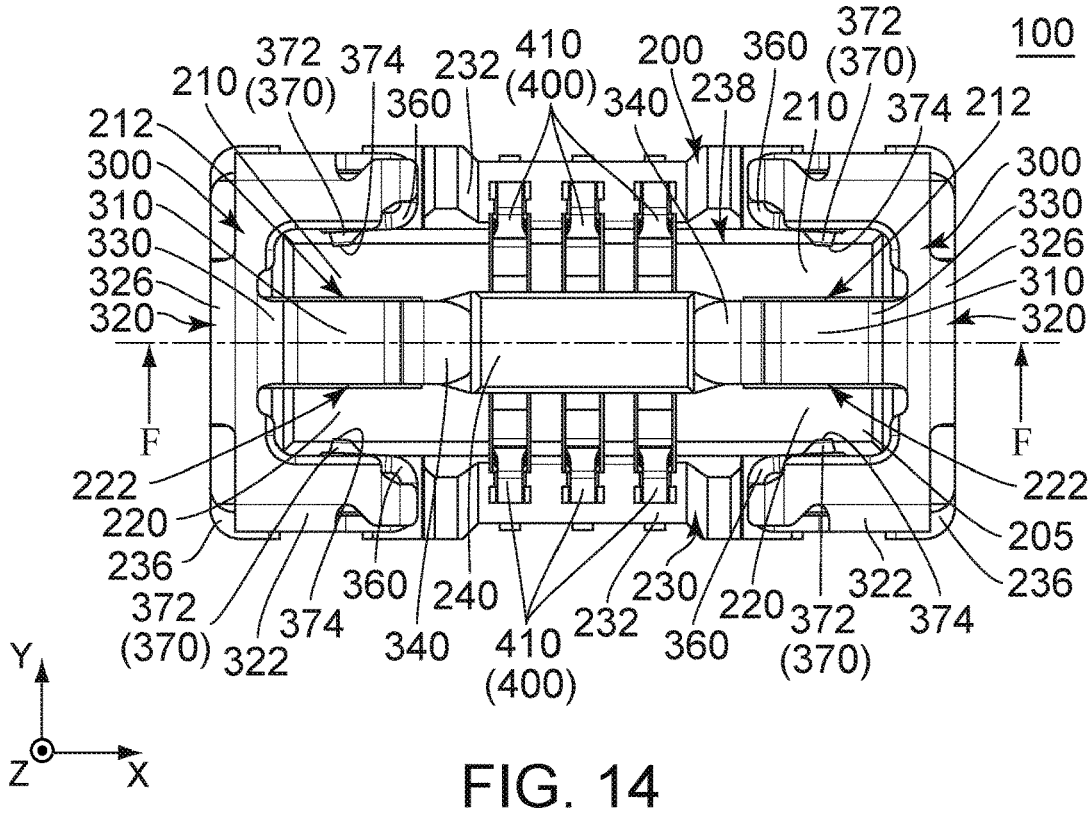
FIG. 14 is a top view showing the second connector of FIG. 13.

Referring to FIG. 14, the second insulator 200 of the present embodiment is made of resin. Specifically, the second insulator 200 has a bottom surface portion 205, a second peripheral portion 230, a first peripheral portion accommodation portion 238 and an island-like portion 240.

Figure 17:
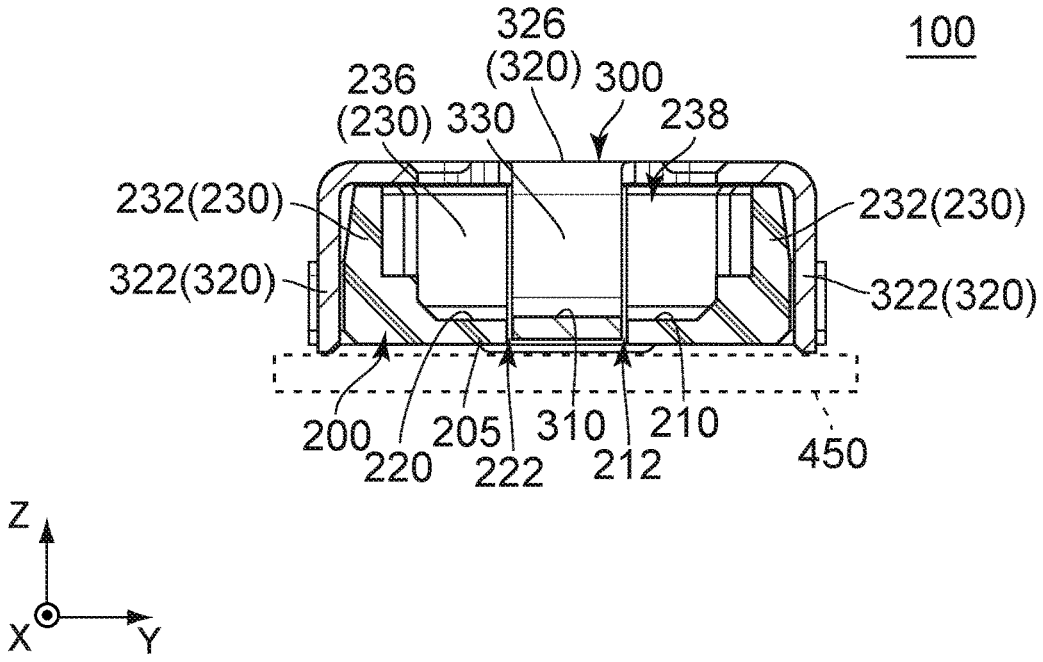
FIG. 17 is a cross-sectional view showing the second connector of FIG. 16, taken along line G-G. In the figure, the second circuit board is illustrated by dotted line.
Figure 18:
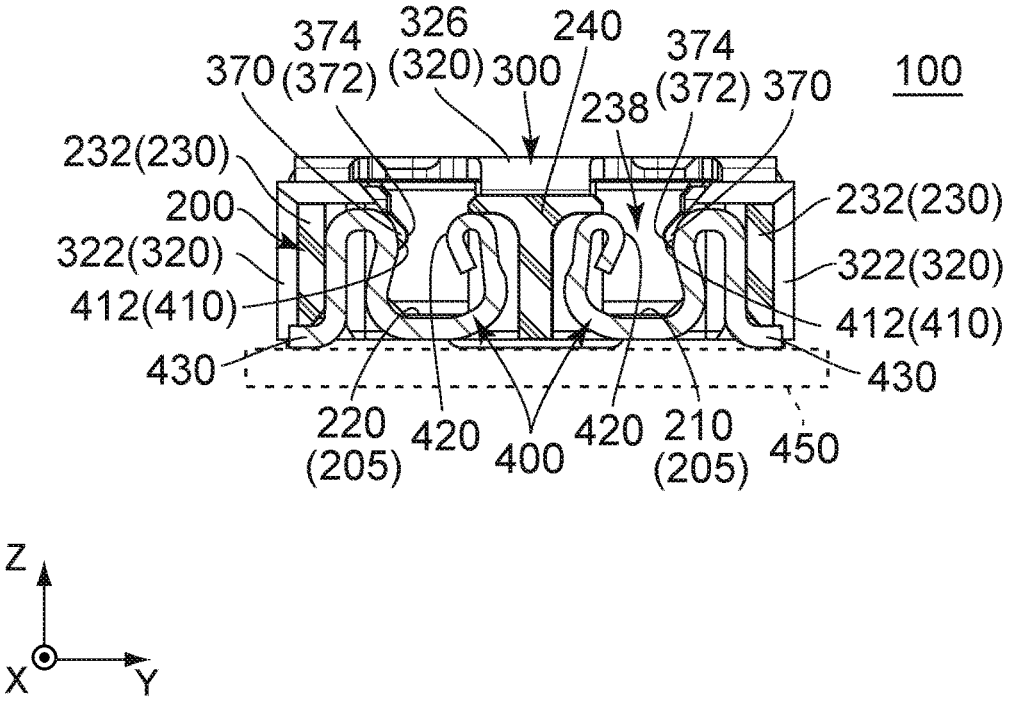
FIG. 18 is a cross-sectional view showing the second connector of FIG. 16, taken along line H-H. In the figure, the second circuit board is illustrated by dotted line.

As shown in FIGS. 15, 17 and 18, the bottom surface portion 205 of the present embodiment has a plate-like shape perpendicular to the up-down direction. The bottom surface portion 205 defines a lower end of the second insulator 200.

As shown in FIGS. 14 and 17, the bottom surface portion 205 of the present embodiment has two insulating planes 210, two boundary portions 212, two insulating planes 220 and two boundary portions 222. In other words, the second insulator 200 of the present embodiment has the two insulating planes 210 and the two insulating planes 220. However, the present invention is not limited thereto. The number of the insulating plane 210, 220 may be one. In other words, the second insulator 200 may have at least one insulating plane 210, 220.

As shown in FIG. 17, each of the insulating planes 210, 220 is a plane perpendicular to the first direction, or to the up-down direction. As shown in FIG. 14, the insulating planes 210 are positioned around opposite ends, respectively, of the bottom surface portion 205 in the third direction while the insulating planes 220 are positioned around the opposite ends, respectively, of the bottom surface portion 205 in the third direction. The insulating plane 210 is positioned beyond the insulating plane 220 in a positive Y-direction of the second direction.

As shown in FIGS. 14 and 17, the boundary portion 212 of the present embodiment is positioned at an inner end of the insulating plane 210 in the second direction. The boundary portion 222 of the present embodiment is positioned at an inner end of the insulating plane 220 in the second direction.

As shown in FIG. 14, the second peripheral portion 230 of the present embodiment has a rectangular outer periphery when viewed along the up-down direction. Each of the insulating planes 210, 220 is surrounded by the second peripheral portion 230 in the plane perpendicular to the up-down direction. The second peripheral portion 230 has two second longer walls 232 and two second shorter walls 236.

As shown in FIG. 17, each of the second longer walls 232 defines an outer end of the second peripheral portion 230 in the second direction. A lower end of the second longer wall 232 is coupled with the bottom surface portion 205.

As shown in FIG. 15, each of the second shorter walls 236 of the present embodiment defines an outer end of the second peripheral portion 230 in the third direction. A lower end of the second shorter wall 236 is coupled with the bottom surface portion 205. As shown in FIG. 14, opposite ends of the second shorter walls 236 in the second direction are coupled with the second longer walls 232, respectively.

As shown in FIG. 13, the first peripheral portion accommodation portion 238 of the present embodiment is a recess which is opened at its upper end. In other words, the first peripheral portion accommodation portion 238 is recessed downward in the up-down direction. As shown in FIG. 14, each of the insulating planes 210, 220 is positioned in the first peripheral portion accommodation portion 238. The bottom surface portion 205 defines a lower end of the first peripheral portion accommodation portion 238. The first peripheral portion accommodation portion 238 is surrounded by the second peripheral portion 230 in the plane perpendicular to the up-down direction.

As shown in FIG. 15, the island-like portion 240 of the present embodiment protrudes upward from the bottom surface portion 205. As shown in FIG. 14, the island-like portion 240 is surrounded by the first peripheral portion accommodation portion 238 in the plane perpendicular to the up-down direction. Specifically, in the plane perpendicular to the up-down direction, the island-like portion 240 is surrounded by the second peripheral portion 230 with the first peripheral portion accommodation portion 238 left between the island-like portion 240 and the second peripheral portion 230. The island-like portion 240 is positioned between the two insulating planes 210 in the third direction. The island-like portion 240 is positioned between the two insulating planes 220 in the third direction.

Referring to FIG. 13, each of the second metal members 300 of the present embodiment is made of metal. Each of the second metal members 300 is held by the second insulator 200.

As shown in FIG. 14, each of the second metal members 300 of the present embodiment has a main held portion 320, a connecting portion 330, a second metal plane 310 and an auxiliary held portion 340.

As shown in FIG. 14, the main held portion 320 of the present embodiment is held by the second peripheral portion 230 of the second insulator 200. The main held portion 320 of the present embodiment has first held portions 322 and a second held portion 326.

As shown in FIGS. 13 and 14, the first held portions 322 of the present embodiment are held by the second longer walls 232, respectively, of the second peripheral portion 230 of the second insulator 200. Each of the first held portions 322 has a resilient deformable portion 360 and a second additional member 370. Specifically, the second metal member 300 of the present embodiment has the second additional members 370. In other words, each of the second additional members 370 is formed as a part of the second metal member 300.

As shown in FIGS. 13 to 15, the resilient deformable portion 360 of the present embodiment extends outward in the third direction. An outer end of the resilient deformable portion 360 in the third direction is a free end. The resilient deformable portion 360 is resiliently deformable in the second direction.

As shown in FIGS. 13 and 14, the second additional member 370 of the present embodiment is held by the second insulator 200. The second additional member 370 protrudes inward in the second direction from the resilient deformable portion 360. Since the resilient deformable portion 360 is resiliently deformable in the second direction as described above, the second additional member 370 is movable in the second direction. Under a state where the first connector 500 and the second connector 100 are not mated with each other, the second additional member 370 is positioned in the first peripheral portion accommodation portion 238. The second additional member 370 has a contact surface 372. The contact surface 372 is a surface intersecting with both the second direction and the first direction which is the up-down direction. The contact surface 372 extends downward in the up-down direction and inward in the second direction from the resilient deformable portion 360. The contact surface 372 has an inner end 374. The inner end 374 is the innermost end of the contact surface 372 in the second direction.

As shown in FIGS. 13 to 15, the second held portion 326 of the present embodiment is held by the second shorter wall 236 of the second peripheral portion 230 of the second insulator 200.

As shown in FIGS. 13 to 15, the connecting portion 330 of the present embodiment extends downward in the up-down direction from a part of the second held portion 326 of the main held portion 320, which is an inner end of the second held portion 326 in the third direction. The connecting portion 330 connects the main held portion 320 and the second metal plane 310 with each other. Specifically, the connecting portion 330 connects a part of the second held portion 326, which is the inner end of the second held portion 326 in the third direction, with a part of the second metal plane 310, which is an outer end of the second metal plane 310 in the third direction.

As shown in FIG. 17, the second metal plane 310 of the present embodiment is a plane perpendicular to the first direction, or to the up-down direction. The second metal plane 310 is arranged adjacent to any of the insulating plane 210 and the insulating plane 220 in the second direction. More specifically, the second connector 100 has two sets each consisting of the second metal member 300, the insulating plane 210, the boundary portion 212, the insulating plane 220 and the boundary portion 222. In each set, the second metal plane 310 of the second metal member 300 is arranged adjacent to any of the two insulating planes 210, 220 in the second direction. However, the present invention is not limited thereto. The arrangement of the second metal plane 310 may be modified, provided that the second metal plane 310 is arranged adjacent to the at least one insulating plane 210, 220 in the second direction perpendicular to the first direction, or to the up-down direction.

As shown in FIG. 17, the second metal plane 310 of the present embodiment is positioned between the insulating plane 210 and the insulating plane 220 in the second direction. More specifically, in each set, the second metal plane 310 is positioned between the two insulating planes 210, 220 in the second direction. In detail, the second metal plane 310 is positioned between the boundary portion 212 and the boundary portion 222 in the second direction. More specifically, in each set, the second metal plane 310 is positioned between the two boundary portions 212, 222 in the second direction. As shown in FIG. 6, the second metal plane 310 is positioned above any of the insulating plane 210 and the insulating plane 220 in the first direction, or in the up-down direction. More specifically, in each set, the second metal plane 310 is positioned above any of the two insulating planes 210, 220 in the first direction.

Figure 2:
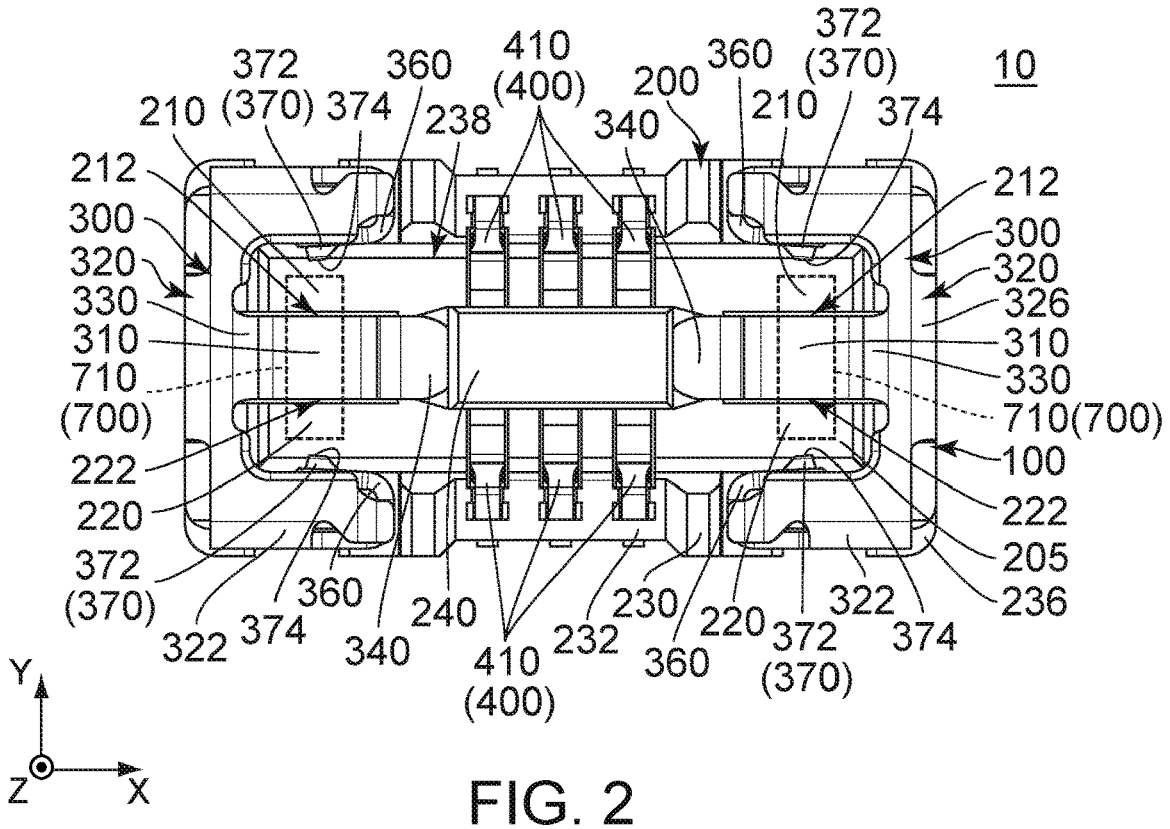
FIG. 2 is a top view showing the connector assembly of FIG. 1. Regarding a first connector, only an outline of each of first metal members is illustrated by dotted line in the figure.
Figure 3:
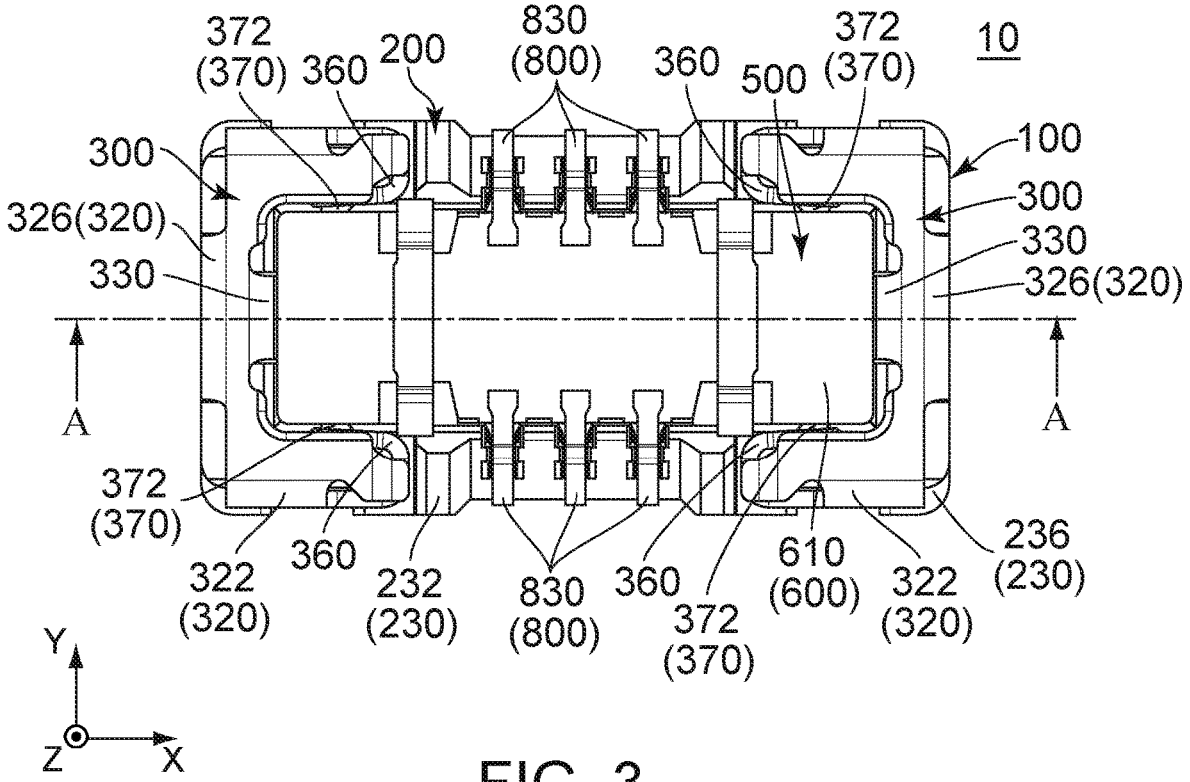
FIG. 3 is another top view showing the connector assembly of FIG. 1.

As shown in FIG. 2, in the second direction, the second metal plane 310 of the present embodiment has a dimension smaller than a dimension of the first metal plane 710. That is, in the second direction, the first metal plane 710 of the present embodiment has the dimension greater than the dimension of the second metal plane 310.

As shown in FIG. 2, in the third direction perpendicular to both and the second direction and the first direction which is the up-down direction, the second metal plane 310 of the present embodiment has a dimension greater than a dimension of the first metal plane 710. That is, in the third direction perpendicular to both the second direction and the first direction which is the up-down direction, the first metal plane 710 of the present embodiment has the dimension smaller than the dimension of the second metal plane 310.

As shown in FIGS. 14 and 15, the auxiliary held portion 340 extends inward in the third direction from a part of the second metal plane 310, which is an inner end of the second metal plane 310 in the third direction. The auxiliary held portion 340 is held by the island-like portion 240 of the second insulator 200. Specifically, an inner end of the auxiliary held portion 340 in the third direction and its vicinity are held by the island-like portion 240 of the second insulator 200.

As shown in FIG. 18, each of the second terminals 400 of the present embodiment is held by the second insulator 200. Each of the second terminals 400 of the present embodiment is made of conductor. Specifically, each of the second terminals 400 has a second outer contact portion 410, a second inner contact portion 420 and a second fixed portion 430.

As shown in FIG. 18, the second outer contact portion 410 of the present embodiment protrudes inward in the second direction from the second longer wall 232 of the second peripheral portion 230 of the second insulator 200. The second outer contact portion 410 is exposed in the first peripheral portion accommodation portion 238 of the second insulator 200. The second outer contact portion 410 has an inner end 412. The inner end 412 is the innermost end of the second outer contact portion 410 in the second direction.

As shown in FIG. 18, the second inner contact portion 420 of the present embodiment protrudes outward in the second direction from the island-like portion 240 of the second insulator 200. The second inner contact portion 420 is exposed in the first peripheral portion accommodation portion 238 of the second insulator 200. The second inner contact portion 420 is positioned inward of the second outer contact portion 410 in the second direction.

Referring to FIG. 18, the second fixed portion 430 of the present embodiment is soldered to a circuit trace (not shown) of the second circuit board 450 when the second connector 100 is fixed on the second circuit board 450. The second fixed portion 430 extends outward in the second direction from the second outer contact portion 410. In the up-down direction, an outer end of the second fixed portion 430 is positioned outward of an outer end of the bottom surface portion 205 of the second insulator 200. Specifically, in the up-down direction, a lower end of the second fixed portion 430 is positioned below a lower end of the bottom surface portion 205 of the second insulator 200.

A further description will be made below about an operation of mating the first connector 500 with the second connector 100 of the connector assembly 10 of the present embodiment.

First, referring to FIGS. 4, 10 and 15, the first connector 500 and the second connector 100 are positioned so that the island-like portion accommodation portion 640 of the first insulator 600 of the first connector 500 faces the island-like portion 240 of the second insulator 200 of the second connector 100 in the up-down direction. Meanwhile, the first metal planes 710 of the first metal members 700 of the first connector 500 face the second metal planes 310 of the second metal members 300 of the two sets, respectively, of the second connector 100 in the up-down direction.

After this positioning, the first connector 500 and the second connector 100 are moved to approach each other in the up-down direction, and then the first connector 500 is partially inserted into the second connector 100 in the up-down direction. Meanwhile, the first peripheral portion 620 of the first connector 500 is partially accommodated in the first peripheral portion accommodation portion 238 of the second connector 100 while the island-like portion 240 of the second insulator 200 of the second connector 100 is partially accommodated in the island-like portion accommodation portion 640 of the first insulator 600 of the first connector 500.

Figure 7:
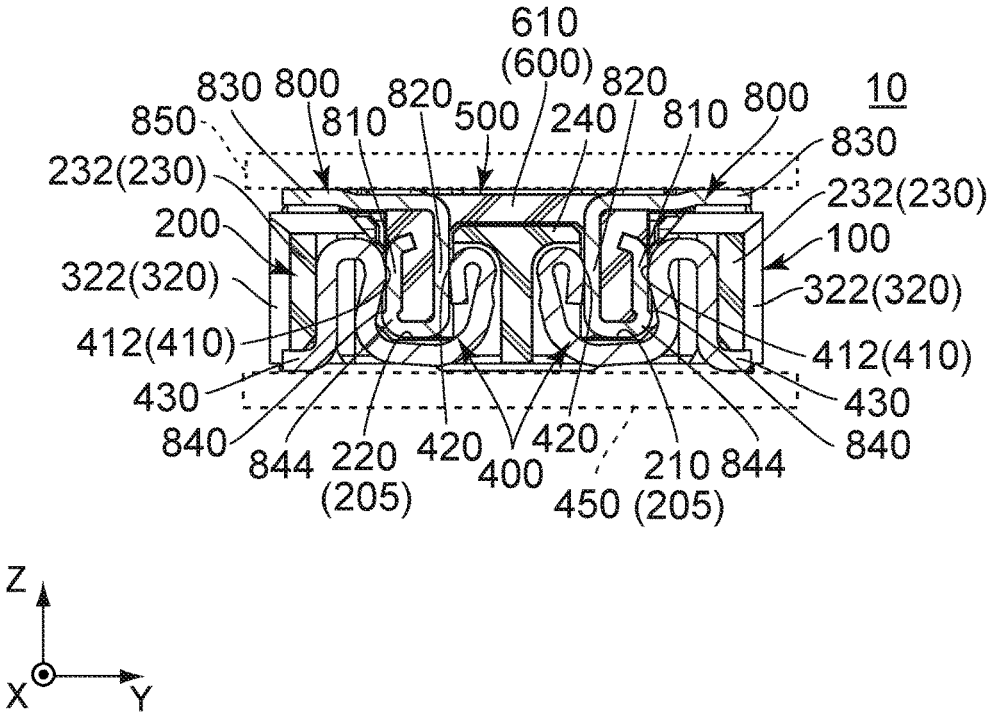
FIG. 7 is a cross-sectional view showing the connector assembly of FIG. 5, taken along line C-C. In the figure, the first circuit board and the second circuit board are illustrated by dotted lines.

Referring to FIGS. 7, 12 and 18, when the first connector 500 and the second connector 100 are further moved to approach each other in the up-down direction, the first inner contact portions 820 of the first terminals 800 of the first connector 500 are brought into contact with the second inner contact portions 420 of the second terminals 400, respectively, of the second connector 100 in the up-down direction and thereby an insertion force of the first connector 500 into the second connector 100 is generated.

When a force is applied to the connector assembly 10 so that the first connector 500 and the second connector 100 are yet further moved to approach each other in the up-down direction, the bent portion 844 of the first terminal 800 of the first connector 500 is moved downward relative to the second connector 100 while being in contact with the second outer contact portion 410 of the second terminal 400 corresponding thereto of the second connector 100. Then, an upper end of the bent portion 844 is brought into contact with the inner end 412 of the second outer contact portion 410 of the second terminal 400 of the second connector 100 in the second direction. The insertion force of the first connector 500 into the second connector 100 is maximum at the time when the upper end of the bent portion 844 is brought into contact with the inner end 412.

After this contact, the force is further applied to the connector assembly 10 so that the first connector 500 and the second connector 100 are still further moved to approach each other in the up-down direction. Then, the step portion 840 of the first terminal 800 of the first connector 500 rides over the inner end 412 of the second outer contact portion 410 of the second terminal 400 corresponding thereto of the second connector 100 and is moved downward relative to the second connector 100. Also, the first outer contact portion 810 of the first terminal 800 of the first connector 500 is brought into contact with the second outer contact portion 410 of the second terminal 400 corresponding thereto of the second connector 100 in the second direction. The insertion force of the first connector 500 into the second connector 100 is reduced after the step portion 840 of the first terminal 800 of the first connector 500 rides over the inner end 412 of the second outer contact portion 410 of the second terminal 400 corresponding thereto of the second connector 100.

Specifically, upon the mating of the first connector 500 with the second connector 100, a contact state between the first terminal 800 and the second terminal 400 is changed so that the insertion force of the first connector 500 into the second connector 100 is changed.

After that, the force is yet further applied to the connector assembly 10 so that the first connector 500 and the second connector 100 are still yet further moved to approach each other in the up-down direction. Then, the first metal plane 710 of the first metal member 700 of the first connector 500 abuts against the second metal plane 310 of the second metal member 300 corresponding thereto of the second connector 100. Meanwhile, the mating of the first connector 500 with the second connector 100 has been completed so that the first connector 500 and the second connector 100 are in a mated state where the first connector 500 and the second connector 100 are mated with each other. In other words, when the first connector 500 is mated with the second connector 100, the first metal plane 710 of the first metal member 700 of the first connector 500 abuts against the second metal plane 310 of the second metal member 300 of the second connector 100 in the first direction, or in the up-down direction. When the first metal plane 710 abuts against the second metal plane 310, a rather loud metallic sound is produced. Thus, an operator can easily and reliably recognize arrivals of the first connector 500 and the second connector 100 at their regular mating positions by hearing the metallic sound.

In other words, the connector assembly 10 of the present embodiment is configured as follows. Upon the mating of the first connector 500 with the second connector 100, the first connector 500 is partially inserted into the second connector 100 in the first direction, or in the up-down direction. Upon the insertion of the first connector 500 into the second connector 100, the first connector 500 abuts against the second metal plane 310 at the first metal plane 710 in the first direction, or in the up-down direction, after the first connector 500 is inserted into the second connector 100 in the first direction, or in the up-down direction, beyond a point at which the insertion force of the first connector 500 into the second connector 100 in the first direction, or in the up-down direction, is maximum. Upon the abutment of the first metal plane 710 against the second metal plane 310, the mating of the first connector 500 with the second connector 100 has been completed.

If the connector assembly 10 is used as a board-to-board connector assembly in which the first connector 500 fixed on the first circuit board 850 is mated with the second connector 100 fixed on the second circuit board 450, an operator cannot visually inspect an insertion status of the first connector 500 into the second connector 100. The connector assembly 10 of the present embodiment has the aforementioned effect that an operator can recognize the completion of the mating of the first connector 500 with the second connector 100 by hearing the metallic sound which is produced by the abutment of the first metal plane 710 against the second metal plane 310. The aforementioned effect is especially beneficial when the connector assembly 10 of the present embodiment is used as such a board-to-board connector assembly.

As shown in FIGS. 2 and 6, under the mated state where the first connector 500 and the second connector 100 are mated with each other, the first metal plane 710, at least in part, faces each of the second metal plane 310 and the two insulating planes 210, 220 of the corresponding set in the first direction, or in the up-down direction. However, the present invention is not limited thereto. The arrangement of the first metal plane 710 may be modified, provided that the first metal plane 710, at least in part, faces each of the second metal plane 310 and the at least one insulating plane 210, 220 in the first direction, or in the up-down direction, under the mated state where the first connector 500 and the second connector 100 are mated with each other.

As shown in FIGS. 2 and 6, under the mated state where the first connector 500 and the second connector 100 are mated with each other, the first metal plane 710 traverses any of the two boundary portions 212, 222 of the corresponding set, wherein, in each set, the boundary portion 212 is positioned between the second metal plane 310 and the insulating plane 210 in the second direction while the boundary portion 222 is positioned between the second metal plane 310 and the insulating plane 220 in the second direction. However, the present invention is not limited thereto. The position of the first metal plane 710 may be modified, provided that the first metal plane 710 traverses a boundary portion 212, 222 which is positioned between the second metal plane 310 and the at least one insulating plane 210, 220 in the second direction.

As shown in FIG. 6, the connector assembly 10 of the present embodiment has a first distance D2 from the first metal plane 710 to the insulating plane 210 of the corresponding set in the first direction, or in the up-down direction, under the mated state. The connector assembly 10 of the present embodiment has a second distance D3 from the first metal plane 710 to the insulating plane 220 of the corresponding set in the first direction, or in the up-down direction, under the mated state. Under the mated state where the first connector 500 and the second connector 100 are mated with each other, a specific distance D1 from the first metal plane 710 to the second metal plane 310 corresponding thereto in the first direction, or in the up-down direction, is shorter than any of the first distance D2 and the second distance D3. However, the present invention is not limited thereto. The requirements for the specific distance D1 may be modified, provided that, under the mated state where the first connector 500 and the second connector 100 are mated with each other, the specific distance D1 from the first metal plane 710 to the second metal plane 310 in the first direction, or in the up-down direction, is shorter than a distance from the first metal plane 710 to the at least one insulating plane 210, 220 in the first direction, or in the up-down direction.

Under the mated state where the first connector 500 and the second connector 100 are mated with each other, the first metal plane 710 and the second metal plane 310 may or may not be in contact with each other in the up-down direction. In other words, under the mated state where the first connector 500 and the second connector 100 are mated with each other, the first metal plane 710 and the second metal plane 310 may or may not be positioned apart from each other in the up-down direction. As shown in FIG. 6, the connector assembly 10 of the present embodiment is configured so that the first metal plane 710 and the second metal plane 310 corresponding thereto are in contact with each other in the up-down direction under the mated state where the first connector 500 and the second connector 100 are mated with each other.

Referring to FIGS. 3, 7, 8 and 14, under the mated state where the first connector 500 and the second connector 100 are mated with each other, the side surface portions 730 of the first additional members 770 of the first metal member 700 of the first connector 500 are in contact with the inner ends 374 of the contact surfaces 372 of the second additional members 370, respectively, of the second metal member 300 corresponding thereto of the second connector 100 in the second direction while the first terminal 800 of the first connector 500 is in contact with the second terminal 400 corresponding thereto of the second connector 100.

Second Embodiment

Figure 19:
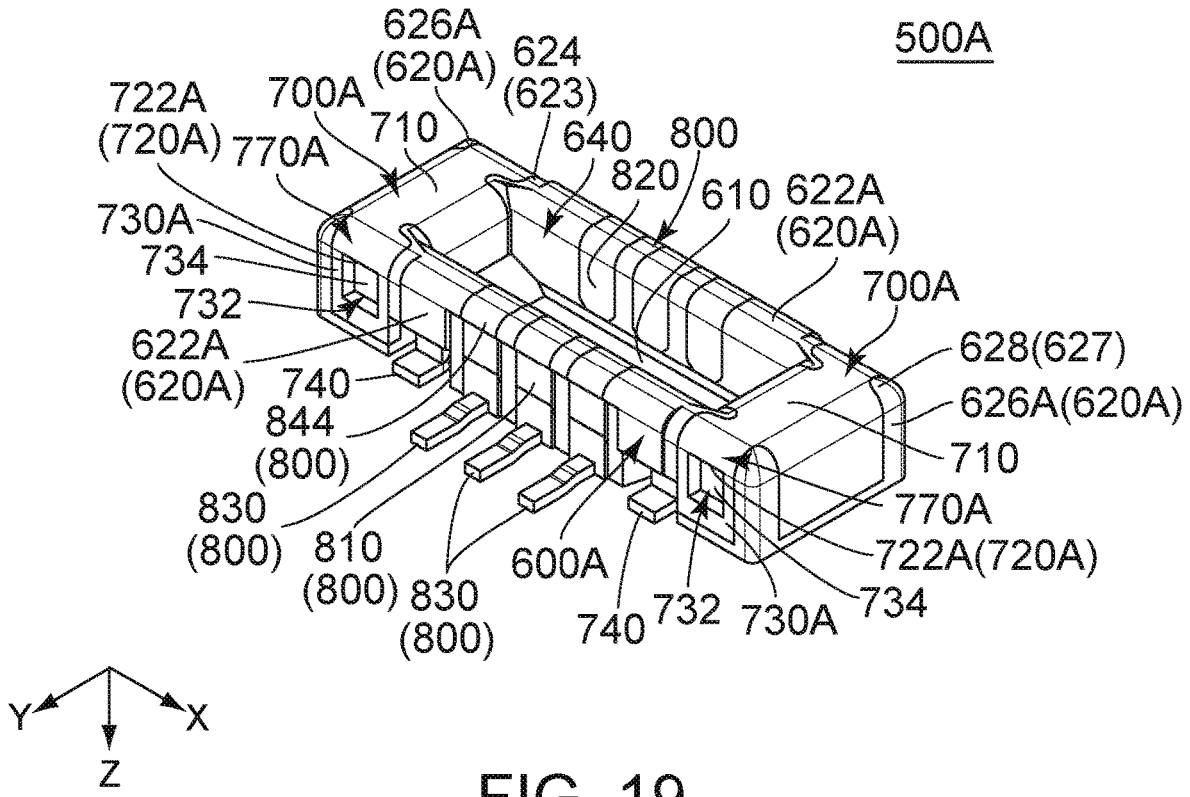
FIG. 19 is a lower perspective view showing a first connector which is included in a connector assembly according to a second embodiment of the present invention.
Figure 20:
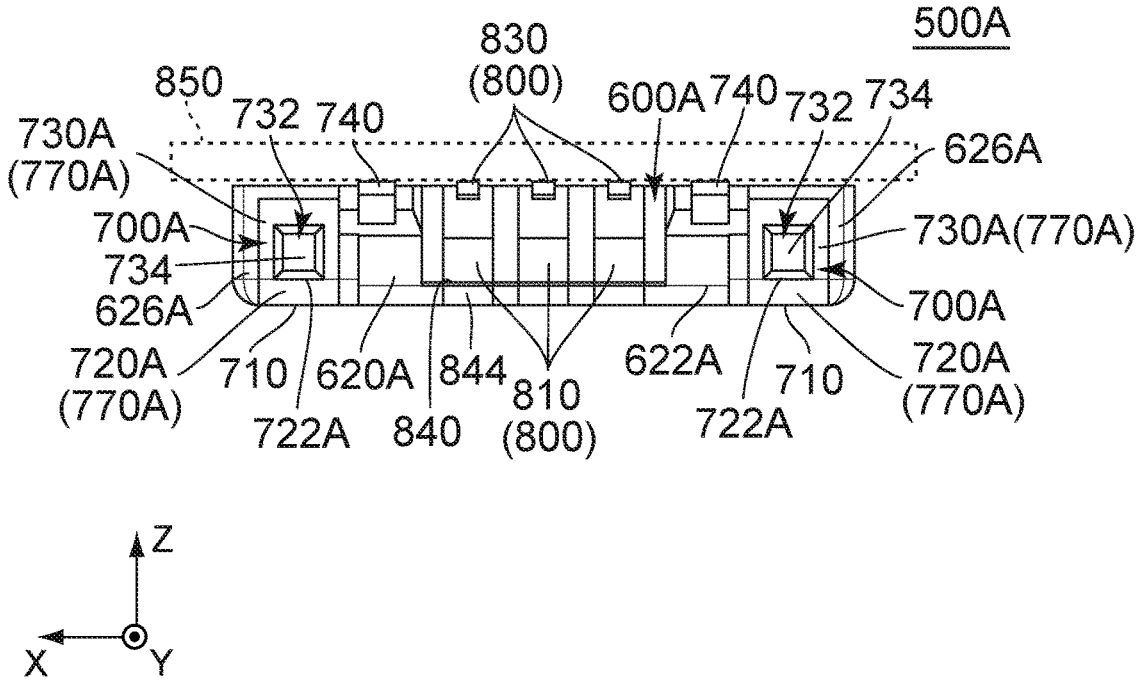
FIG. 20 is a side view showing the first connector of FIG. 19. In the figure, a first circuit board is illustrated by dotted line.

Referring to FIGS. 1, 19 and 20, a connector assembly (not shown) according to a second embodiment of the present invention has a structure similar to that of the connector assembly 10 according to the aforementioned first embodiment as shown in FIG. 1. Components of a first connector 500A shown in FIGS. 19 and 20 which are same as those of the first connector 500 of the first embodiment are referred by using reference signs same as those of the first connector 500 of the first embodiment. As for directions and orientations in the present embodiment, expressions same as those of the first embodiment will be used hereinbelow.

Referring to FIGS. 1, 19 and 20, the connector assembly according to the present embodiment comprises the first connector 500A and a second connector 100. The second connector 100 of the present embodiment has a structure same as that of the second connector 100 of the first embodiment. Accordingly, detailed explanation thereabout is omitted.

Referring to FIGS. 1 and 19, the first connector 500A of the present embodiment is mateable with and removable from the second connector 100 along the first direction, or in the up-down direction.

As shown in FIG. 20, the first connector 500A according to the present embodiment is fixed on a first circuit board 850 when used.

As shown in FIGS. 19 and 20, the first connector 500A according to the present embodiment comprises a first insulator 600A, two first metal members 700A and a plurality of first terminals 800. The first terminal 800 of the present embodiment has a structure same as that of the first terminal 800 of the first embodiment. Accordingly, detailed explanation thereabout is omitted. Although the first connector 500A of the present embodiment comprises the plurality of first terminals 800, the present invention is not limited thereto. The number of the first terminal 800 may be one. In other words, the first connector 500A may comprise at least one first terminal 800. In addition, the first connector 500A may be modified, provided that the first connector 500A comprises the first insulator 600A and the first metal member 700A. In other words, the first connector 500A may not comprise the first terminal 800.

Referring to FIGS. 19 and 20, the first insulator 600A of the present embodiment is made of resin. Specifically, the first insulator 600A has an upper surface portion 610, a first peripheral portion 620A and an island-like portion accommodation portion 640. Components of the first insulator 600A other than the first peripheral portion 620A have structures same as those of the first insulator 600 of the first embodiment. Accordingly, detailed explanation about the components other than the first peripheral portion 620A is omitted.

As shown in FIGS. 19 and 20, the first peripheral portion 620A of the present embodiment has a rectangular outer periphery when viewed along the up-down direction. The first peripheral portion 620A has two first longer walls 622A and two first shorter walls 626A.

As shown in FIGS. 19 and 20, the first longer walls 622A of the present embodiment face each other in the second direction. An upper end of the first longer wall 622A is coupled with the upper surface portion 610. The first longer wall 622A has adjacent portions 623 which are arranged adjacent to the first metal members 700A, respectively.

As shown in FIGS. 19 and 20, the first shorter walls 626A of the present embodiment face each other in the third direction. An upper end of the first shorter wall 626A is coupled with the upper surface portion 610. Opposite ends of the first shorter wall 626A in the second direction are coupled with the first longer walls 622A, respectively. A lower end of the first shorter wall 626A is positioned at a position same as a position of a lower end of the first longer wall 622A in the up-down direction. The first shorter wall 626A has an adjacent portion 627 which is arranged adjacent to the first metal member 700A.

As shown in FIGS. 19 and 20, each of the first metal members 700A of the present embodiment is held by the first insulator 600A. More specifically, the first metal members 700A are held by opposite ends, respectively, of the first insulator 600A in the third direction.

Referring to FIGS. 19 and 20, each of the first metal members 700A of the present embodiment is made of metal. Specifically, each of the first metal members 700A has a first metal plane 710, first additional members 770A and first metal member fixed portions 740. Components of the first metal member 700A other than the first additional member 770A have structures same as those of the first metal member 700 of the first embodiment. Accordingly, detailed explanation about the components other than the first additional member 770A is omitted.

As shown in FIGS. 19 and 20, each of the first additional members 770A has a coupling portion 720A and a side surface portion 730A.

Referring to FIGS. 19 and 20, the coupling portion 720A of the present embodiment has a rounded cross-section which is perpendicular to the third direction. In other words, an outer surface of the coupling portion 720A is a rounded surface. The coupling portion 720A couples the first metal plane 710 with the side surface portion 730A. The coupling portion 720A has an end portion 722A. The end portion 722A is an upper end of the coupling portion 720A.

As shown in FIGS. 19 and 20, the side surface portion 730A of the present embodiment faces outward in the second direction.

As shown in FIGS. 19 and 20, the side surface portion 730A has a recess 732. The recess 732 is recessed inward in the second direction. A lower end of the recess 732 is the end portion 722A of the coupling portion 720A. The recess 732 has an inner surface 734 which faces outward in the second direction.

A further description will be made below about an operation of mating the first connector 500A with the second connector 100 of the connector assembly of the present embodiment.

First, referring to FIGS. 13, 19 and 20, the first connector 500A and the second connector 100 are positioned so that the island-like portion accommodation portion 640 of the first insulator 600A of the first connector 500A faces an island-like portion 240 of a second insulator 200 of the second connector 100 in the up-down direction. Meanwhile, the first metal planes 710 of the first metal members 700A of the first connector 500A face second metal planes 310 of second metal members 300 of two sets, respectively, of the second connector 100 in the up-down direction.

After this positioning, the first connector 500A and the second connector 100 are moved to approach each other in the up-down direction, and then the first connector 500A is partially inserted into the second connector 100 in the up-down direction. Meanwhile, the first peripheral portion 620A of the first insulator 600A of the first connector 500A is partially accommodated in a first peripheral portion accommodation portion 238 of the second connector 100 while the island-like portion 240 of the second insulator 200 of the second connector 100 is partially accommodated in the island-like portion accommodation portion 640 of the first insulator 600A of the first connector 500A.

When the first connector 500A and the second connector 100 are further moved to approach each other in the up-down direction, the coupling portions 720A of the first metal member 700A of the first connector 500A are brought into contact with contact surfaces 372 of second additional members 370, respectively, of the second metal member 300 corresponding thereto of the second connector 100 in the up-down direction and thereby an insertion force of the first connector 500A into the second connector 100 is generated.

When a force is applied to the connector assembly so that the first connector 500A and the second connector 100 are yet further moved to approach each other in the up-down direction, the coupling portion 720A of the first connector 500A is moved downward relative to the second connector 100 while moving the second additional member 370 corresponding thereto of the second connector 100 outward in the second direction. Then, the end portion 722A of the coupling portion 720A of the first connector 500A is brought into contact with an inner end 374 (see FIG. 15) of the contact surface 372 corresponding thereto of the second connector 100 in the second direction. The insertion force of the first connector 500A into the second connector 100 is maximum at the time when the end portion 722A of the first connector 500A is brought into contact with the inner end 374 corresponding thereto of the second connector 100 in the second direction.

After this contact, the force is further applied to the connector assembly so that the first connector 500A and the second connector 100 are still further moved to approach each other in the up-down direction. Then, the end portion 722A of the first connector 500 rides over the inner end 374 corresponding thereto of the second connector 100 and is moved downward. Also, the second additional members 370 of the second metal member 300 of the second connector 100 are received in the recesses 732, respectively, of the first metal member 700A corresponding thereto of the first connector 500A. Meanwhile, the inner ends 374 of the second metal member 300 of the second connector 100 are in contact with the inner surfaces 734, respectively, of the first metal member 700A corresponding thereto of the first connector 500A in the second direction. The insertion force of the first connector 500A into the second connector 100 is reduced after the end portion 722A of the first connector 500A rides over the inner end 374 corresponding thereto of the second connector 100.

Specifically, upon the mating of the first connector 500A with the second connector 100, a contact state between the first additional member 770A and the second additional member 370 is changed so that the insertion force of the first connector 500A into the second connector 100 is changed.

After that, the force is yet further applied to the connector assembly so that the first connector 500A and the second connector 100 are yet still further moved to approach each other in the up-down direction. Then, the first metal plane 710 of the first metal member 700A of the first connector 500A abuts against the second metal plane 310 of the second metal member 300 corresponding thereto of the second connector 100. Meanwhile, the mating of the first connector 500A with the second connector 100 has been completed so that the first connector 500A and the second connector 100 are in a mated state where the first connector 500A and the second connector 100 are mated with each other. In other words, when the first connector 500A is mated with the second connector 100, the first metal plane 710 of the first metal member 700A of the first connector 500A abuts against the second metal plane 310 of the second metal member 300 of the second connector 100 in the up-down direction. When the first metal plane 710 abuts against the second metal plane 310, a rather loud metallic sound is produced. Thus, an operator can easily and reliably recognize arrivals of the first connector 500A and the second connector 100 at their regular mating positions by hearing the metallic sound.

In other words, the connector assembly of the present embodiment is configured as follows. Upon the mating of the first connector 500A with the second connector 100, the first connector 500A is partially inserted into the second connector 100 in the first direction, or in the up-down direction. Upon the insertion of the first connector 500A into the second connector 100, the first connector 500A abuts against the second metal plane 310 at the first metal plane 710 in the first direction, or in the up-down direction, after the first connector 500A is inserted into the second connector 100 in the first direction, or in the up-down direction, beyond a point at which the insertion force of the first connector 500A into the second connector 100 in the first direction, or in the up-down direction, is maximum. Upon the abutment of the first metal plane 710 against the second metal plane 310, the mating of the first connector 500A with the second connector 100 has been completed.

Similar to the connector assembly 10 of the first embodiment, the connector assembly of the present embodiment has the aforementioned effect that an operator can recognize the completion of the mating of the first connector 500A with the second connector 100 by hearing the metallic sound. In particular, the aforementioned effect is especially beneficial when the connector assembly of the present embodiment is used as a board-to-board connector assembly.

Referring to FIGS. 2 and 19, under the mated state where the first connector 500A and the second connector 100 are mated with each other, the first metal plane 710, at least in part, faces each of the second metal plane 310 and two insulating planes 210, 220 of the corresponding set in the first direction, or in the up-down direction. However, the present invention is not limited thereto. The arrangement of the first metal plane 710 may be modified, provided that the first metal plane 710, at least in part, faces each of the second metal plane 310 and at least one insulating plane 210, 220 in the first direction, or in the up-down direction, under the mated state where the first connector 500A and the second connector 100 are mated with each other.

Referring to FIGS. 2 and 19, under the mated state where the first connector 500A and the second connector 100 are mated with each other, the first metal plane 710 traverses any of the two boundary portions 212, 222 of the corresponding set, wherein, in each set, the boundary portion 212 is positioned between the second metal plane 310 and the insulating plane 210 in the second direction while the boundary portion 222 is positioned between the second metal plane 310 and the insulating plane 220 in the second direction. However, the present invention is not limited thereto. The position of the first metal plane 710 may be modified, provided that the first metal plane 710 traverses a boundary portion 212, 222 which is positioned between the second metal plane 310 and the at least one insulating plane 210, 220 in the second direction.

Referring to FIG. 6, the connector assembly of the present embodiment has a first distance from the first metal plane 710 to the insulating plane 210 of the corresponding set in the first direction, or in the up-down direction, under the mated state. The connector assembly of the present embodiment has a second distance from the first metal plane 710 to the insulating plane 220 of the corresponding set in the first direction, or in the up-down direction, under the mated state. Under the mated state where the first connector 500A and the second connector 100 are mated with each other, a specific distance from the first metal plane 710 to the second metal plane 310 corresponding thereto in the first direction, or in the up-down direction, is shorter than any of the first distance and the second distance. However, the present invention is not limited thereto. The requirements for the specific distance may be modified, provided that, under the mated state where the first connector 500A and the second connector 100 are mated with each other, the specific distance from the first metal plane 710 to the second metal plane 310 in the first direction, or in the up-down direction, is shorter than a distance from the first metal plane 710 to the at least one insulating plane 210, 220 in the first direction, or in the up-down direction.

Under the mated state where the first connector 500A and the second connector 100 are mated with each other, the first metal plane 710 and the second metal plane 310 may or may not be in contact with each other in the up-down direction. In other words, under the mated state where the first connector 500A and the second connector 100 are mated with each other, the first metal plane 710 and the second metal plane 310 may or may not be positioned apart from each other in the up-down direction. Referring to FIG. 6, the connector assembly of the present embodiment is configured so that the first metal plane 710 and the second metal plane 310 corresponding thereto are in contact with each other in the up-down direction under the mated state where the first connector 500A and the second connector 100 are mated with each other.

Referring to FIGS. 3, 7, 14, 19 and 20, under the mated state where the first connector 500A and the second connector 100 are mated with each other, the inner surfaces 734 of the recesses 732 of the side surface portions 730A of the first additional members 770A of the first metal member 700A of the first connector 500A are in contact with the inner ends 374 of the contact surfaces 372 of the second additional members 370, respectively, of the second metal member 300 corresponding thereto of the second connector 100 in the second direction while the first terminals 800 of the first connector 500A are in contact with second terminals 400, respectively, of the second connector 100.

Third Embodiment

Figure 21:
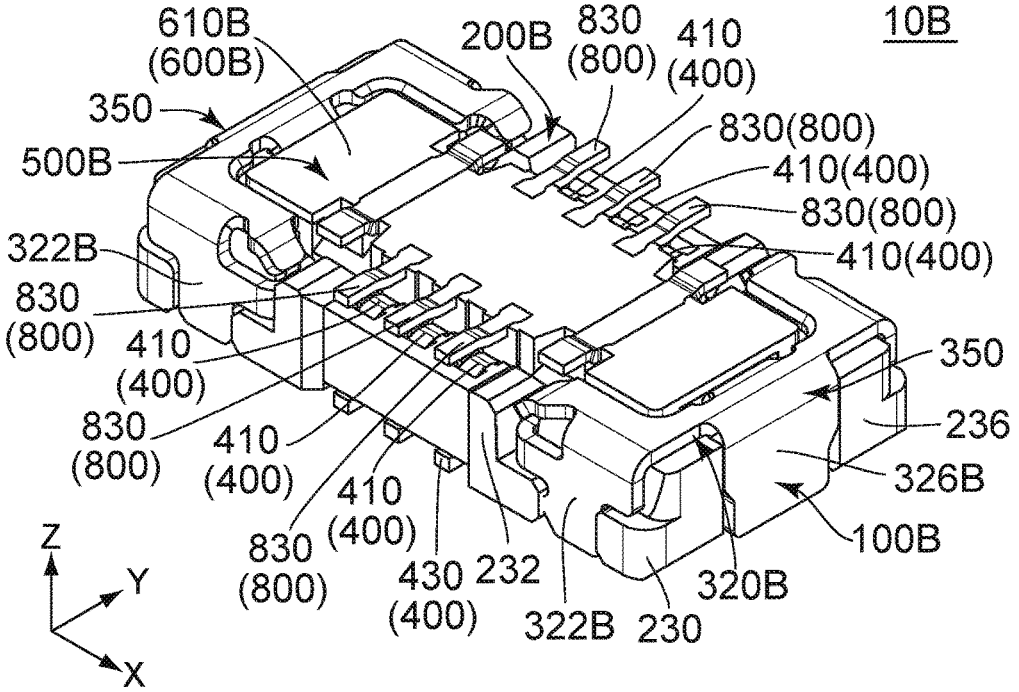
FIG. 21 is an upper perspective view showing a connector assembly according to a third embodiment of the present invention.

As shown in FIG. 21, a connector assembly 10B according to a third embodiment of the present invention has a structure similar to that of the connector assembly 10 according to the aforementioned first embodiment as shown in FIG. 1. Components of the connector assembly 10B shown in FIGS. 21 to 32 which are same as those of the connector assembly 10 of the first embodiment are referred by using reference signs same as those of the connector assembly 10 of the first embodiment. As for directions and orientations in the present embodiment, expressions same as those of the first embodiment will be used hereinbelow.

As shown in FIG. 21, the connector assembly 10B according to the present embodiment comprises a first connector 500B and a second connector 100B.

Figure 24:
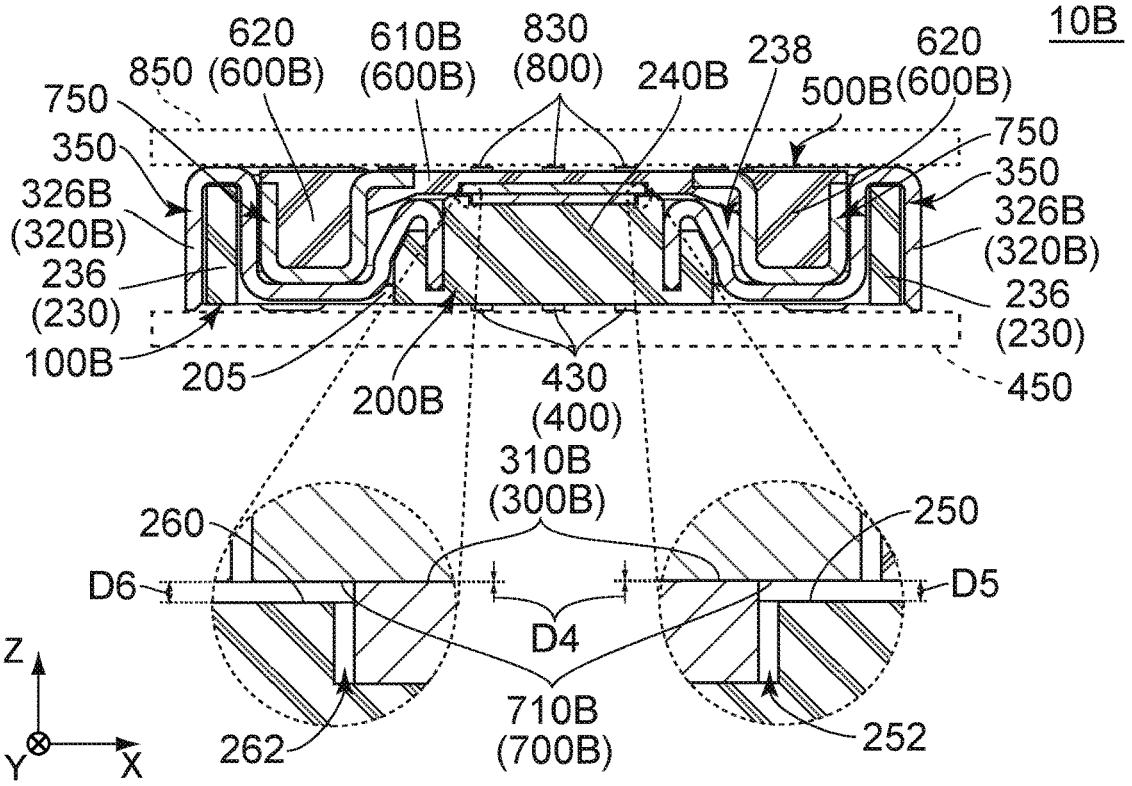
FIG. 24 is a cross-sectional view showing the connector assembly of FIG. 23, taken along line I-I. In the figure, parts of the connector assembly are illustrated enlarged, and a first circuit board and a second circuit board are illustrated by dotted lines.

Referring to FIGS. 21 and 24, the first connector 500B according to the present embodiment is mateable with and removable from the second connector 100B along the first direction, or in the up-down direction.

Figure 27:
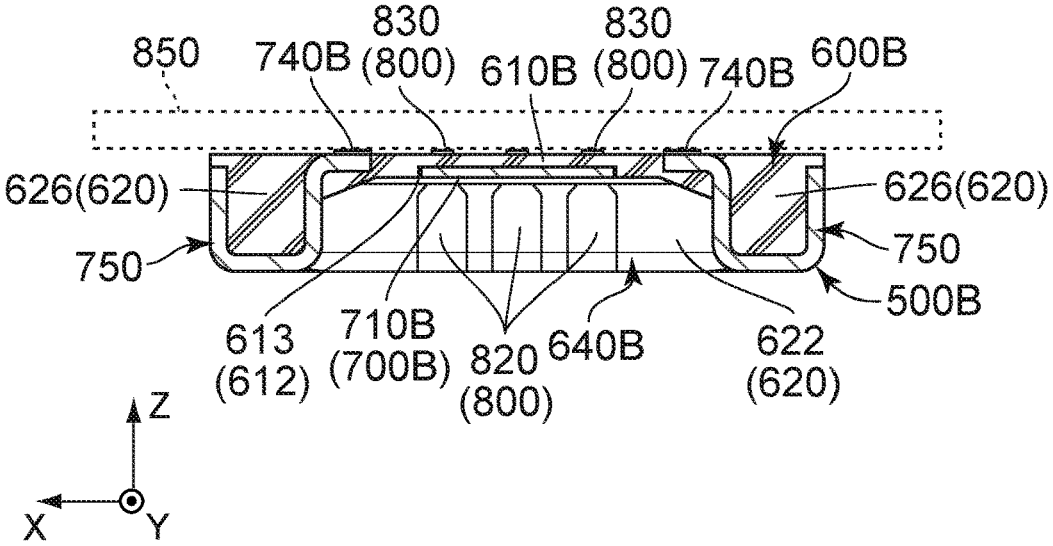
FIG. 27 is a cross-sectional view showing the first connector of FIG. 26, taken along line J-J. In the figure, the first circuit board is illustrated by dotted line.

As shown in FIG. 27, the first connector 500B of the present embodiment is fixed on a first circuit board 850 when used.

Figure 25:
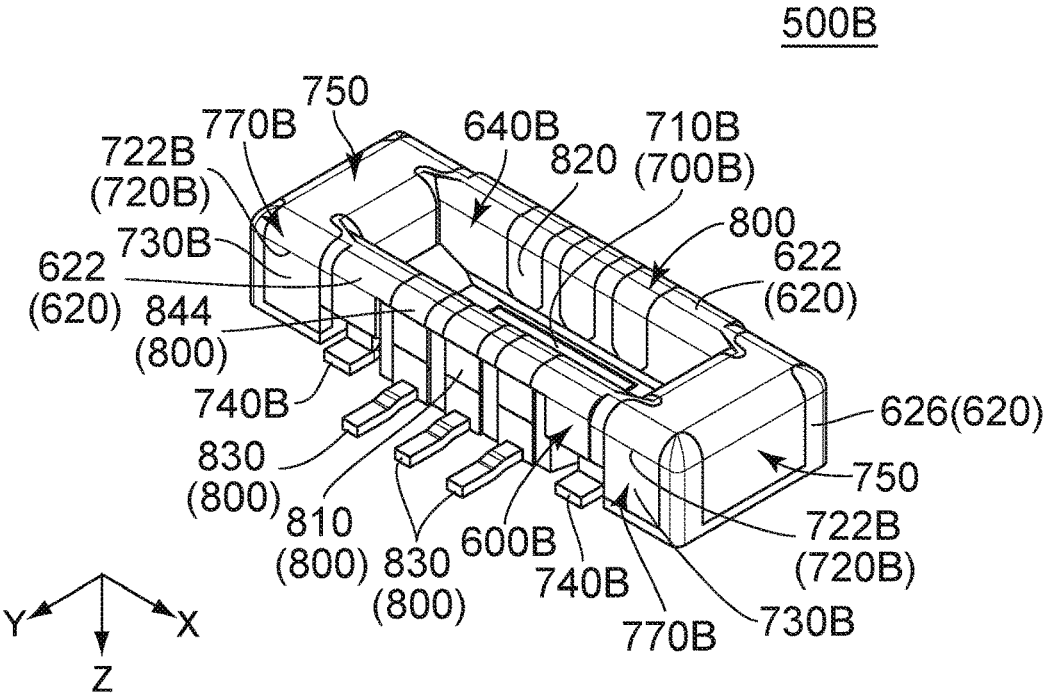
FIG. 25 is a lower perspective view showing the first connector which is included in the connector assembly of FIG. 21.

As shown in FIG. 25, the first connector 500B of the present embodiment comprises a first insulator 600B, a first metal member 700B, a plurality of first terminals 800 and two first additional metal members 750. The first terminal 800 of the present embodiment has a structure same as that of the first terminal 800 of the first embodiment. Accordingly, detailed explanation thereabout is omitted. Although the first connector 500B of the present embodiment comprises the plurality of first terminals 800, the present invention is not limited thereto. The number of the first terminal 800 may be one. In other words, the first connector 500B may comprise at least one first terminal 800. In addition, the first connector 500B may not comprise one of the first terminal 800 and the first additional metal member 750.

Figure 26:
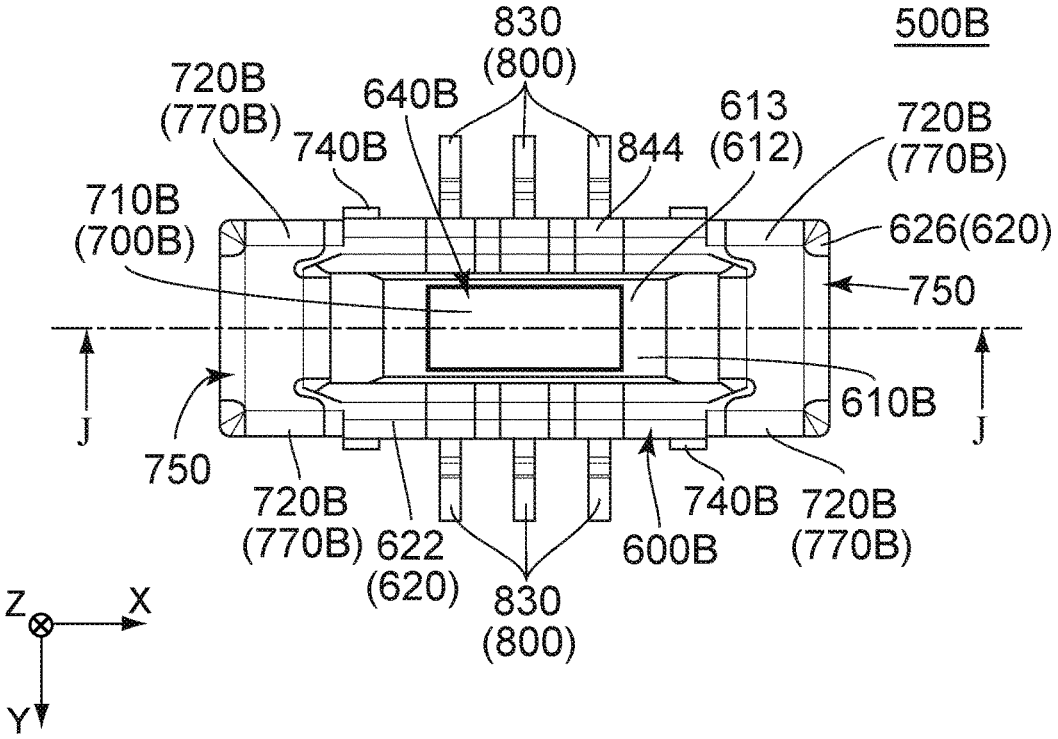
FIG. 26 is a bottom view showing the first connector of FIG. 25.

Referring to FIG. 26, the first insulator 600B of the present embodiment is made of resin. Specifically, the first insulator 600B has an upper surface portion 610B, a first peripheral portion 620 and an island-like portion accommodation portion 640B. Components of the first insulator 600B other than the upper surface portion 610B have structures same as those of the first insulator 600 of the first embodiment. Accordingly, detailed explanation about the components other than the upper surface portion 610B is omitted.

As shown in FIG. 27, the upper surface portion 610B of the present embodiment has a substantially plate-like shape perpendicular to the up-down direction. The upper surface portion 610B defines an upper end of the first insulator 600B. The upper surface portion 610B has an adjacent portion 612 which is arranged adjacent to the first metal member 700B.

As shown in FIGS. 26 and 27, the first metal member 700B of the present embodiment is held by the first insulator 600B. The first metal member 700B is positioned on a lower surface of the upper surface portion 610B of the first insulator 600B. The first metal member 700B is positioned in the island-like portion accommodation portion 640B of the first insulator 600B. The first metal member 700B is surrounded by the first peripheral portion 620 of the first insulator 600B. The first metal member 700B is made of metal. The first metal member 700B has a plate-like shape perpendicular to the first direction, or to the up-down direction. The first metal member 700B has a first metal plane 710B.

As shown in FIGS. 26 and 27, the first metal plane 710B of the present embodiment is a plane perpendicular to the first direction, or to the up-down direction. The first metal plane 710B is positioned at a lower end of the upper surface portion 610B of the first insulator 600B.

The adjacent portion 612 of the first insulator 600B has a portion 613, which is in contact with the first metal plane 710B. The first metal plane 710B is positioned at a position same as a position of a lower end of the portion 613 in the up-down direction. However, the present invention is not limited thereto. The first metal plane 710B may be positioned at a position different from the position of the lower end of the portion 613 of the adjacent portion 612 of the first insulator 600B in the up-down direction.

As shown in FIG. 25, each of the first additional metal members 750 of the present embodiment has first additional members 770B and first metal member fixed portions 740B.

As shown in FIG. 25, each of the first additional members 770B of the present embodiment has a coupling portion 720B and a side surface portion 730B.

Referring to FIGS. 25 and 26, the coupling portion 720B of the present embodiment has a rounded cross-section which is perpendicular to the third direction. In other words, an outer surface of the coupling portion 720 is a rounded surface. The coupling portion 720B is connected with the side surface portion 730B. The coupling portion 720B has an end portion 722B. The end portion 722B is an upper end of the coupling portion 720B.

As shown in FIGS. 25 and 26, the side surface portion 730B of the present embodiment has a plate-like shape perpendicular to the second direction. The side surface portion 730B is positioned at an outer end of a first longer wall 622 of the first peripheral portion 620 of the first insulator 600B in the second direction.

Referring to FIG. 27, each of the first metal member fixed portions 740B is soldered to a circuit trace (not shown) of the first circuit board 850 when the first connector 500B is fixed on the first circuit board 850. As shown in FIG. 26, the first metal member fixed portion 740B extends outward in the second direction from the first longer wall 622 of the first peripheral portion 620 of the first insulator 600B. As shown in FIG. 27, in the up-down direction, an outer end of the first metal member fixed portion 740B is positioned outward of an outer end of the upper surface portion 610B of the first insulator 600B. Specifically, in the up-down direction, an upper end of the first metal member fixed portion 740B is positioned above an upper end of the upper surface portion 610B of the first insulator 600B.

Figure 30:
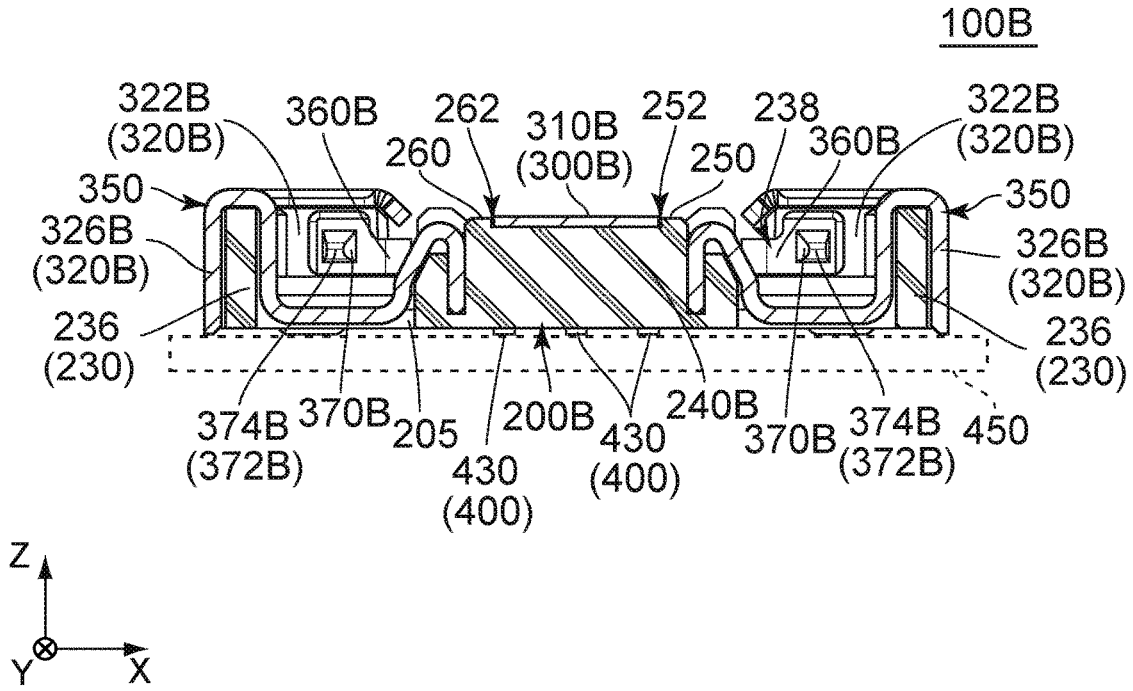
FIG. 30 is a cross-sectional view showing the second connector of FIG. 29, taken along line K-K. In the figure, the second circuit board is illustrated by dotted line.
Figure 31:
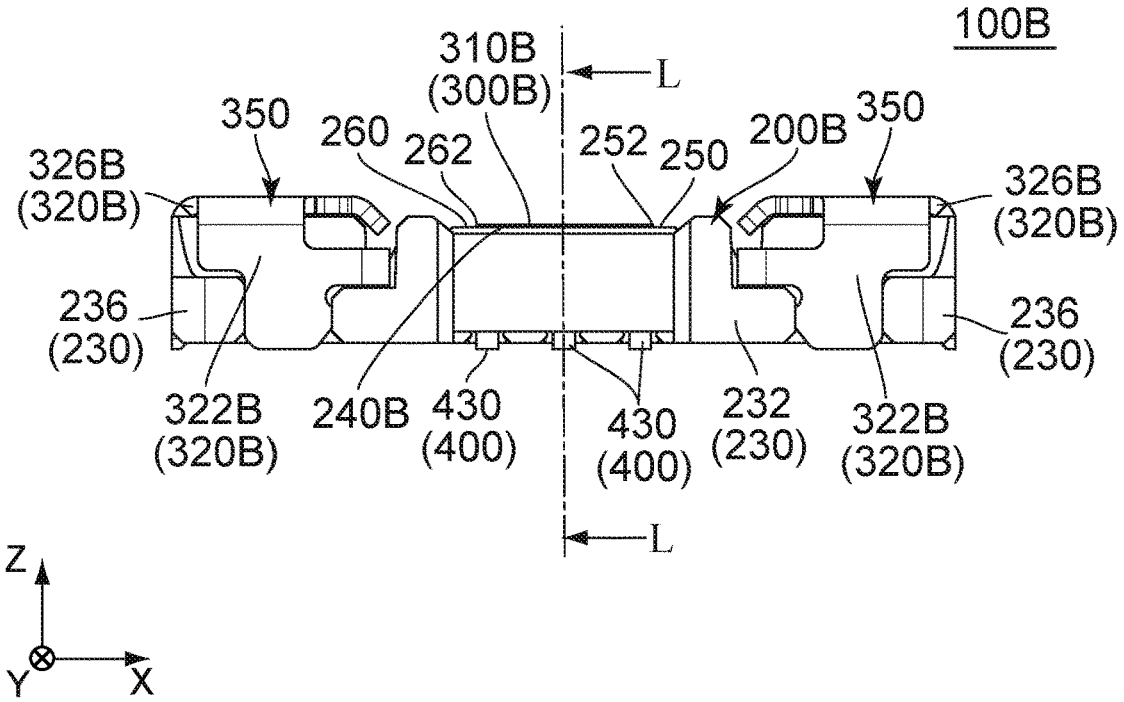
FIG. 31 is a side view showing the second connector of FIG. 28.

As shown in FIG. 30, the second connector 100B according to the present embodiment is fixed on a second circuit board 450 when used, wherein the second circuit board 450 is different from the first circuit board 850.

Figure 28:
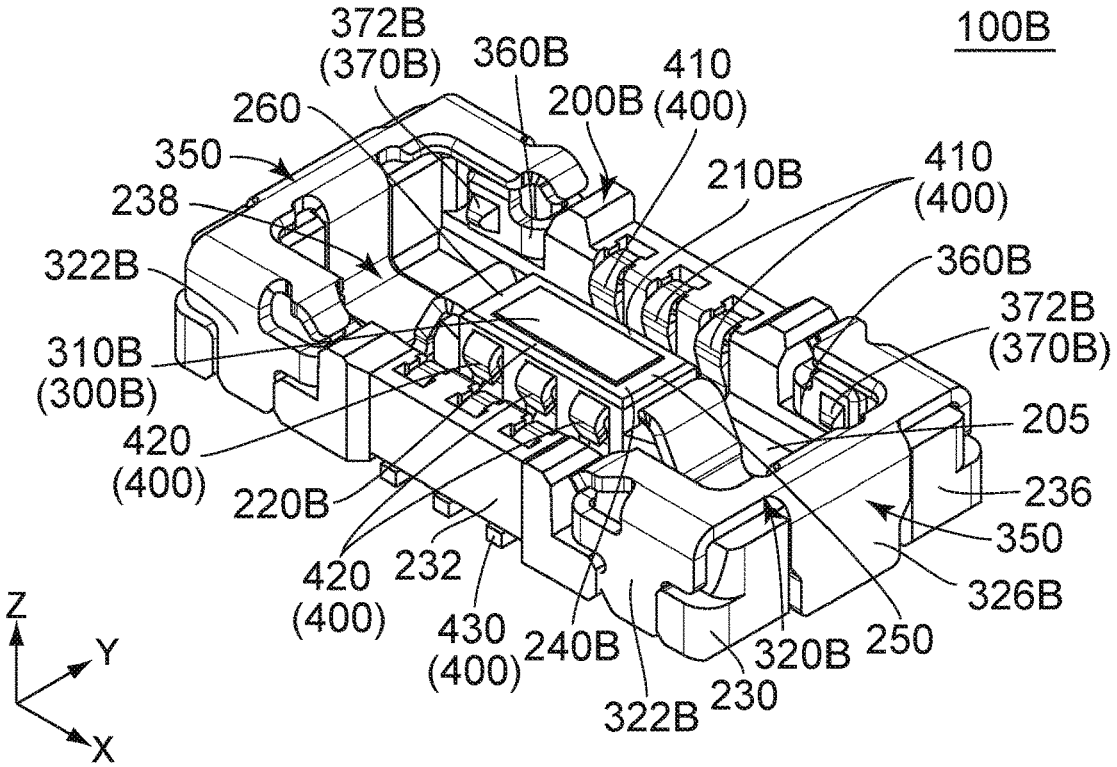
FIG. 28 is an upper perspective view showing a second connector which is included in the connector assembly of FIG. 21.

As shown in FIG. 28, the second connector 100B according to the present embodiment comprises a second insulator 200B, a second metal member 300B, two second additional metal members 350 and a plurality of second terminals 400. The two second additional metal members 350 correspond to the two first additional metal members 750, respectively. The second terminal 400 of the present embodiment has a structure same as that of the second terminal 400 of the first embodiment. Accordingly, detailed explanation thereabout is omitted. Although the second connector 100B of the present embodiment comprises the plurality of second terminals 400, the present invention is not limited thereto. The number of the second terminal 400 may be one. In other words, the second connector 100B may comprise at least one second terminal 400. In addition, the second connector 100B may be modified, provided that the second connector 100B comprises the second insulator 200B and the second metal member 300B. In other words, the second connector 100B may not comprise both of the second terminal 400 and the second additional metal member 350.

Figure 29:
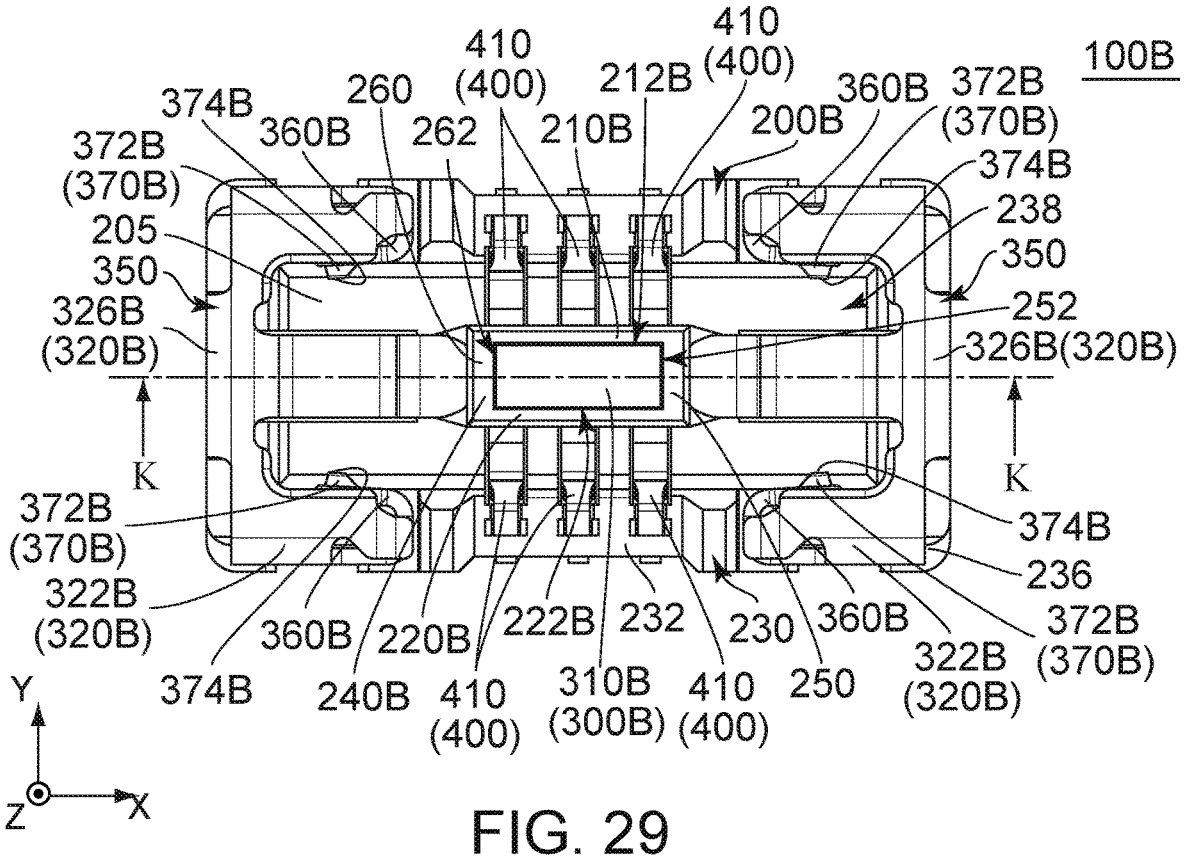
FIG. 29 is a top view showing the second connector of FIG. 28.

Referring to FIG. 29, the second insulator 200B of the present embodiment is made of resin. Specifically, the second insulator 200B has a bottom surface portion 205, a second peripheral portion 230, a first peripheral portion accommodation portion 238 and an island-like portion 240B. Components of the second insulator 200B other than the island-like portion 240B have structures same as those of the second insulator 200 of the first embodiment. Accordingly, detailed explanation about the components other than the island-like portion 240B is omitted.

As shown in FIG. 30, the island-like portion 240B of the present embodiment protrudes upward from the bottom surface portion 205. As shown in FIG. 29, the island-like portion 240B is surrounded by the first peripheral portion accommodation portion 238 in the plane perpendicular to the up-down direction. Specifically, in the plane perpendicular to the up-down direction, the island-like portion 240B is surrounded by the second peripheral portion 230 with the first peripheral portion accommodation portion 238 left between the island-like portion 240B and the second peripheral portion 230.

Figure 32:
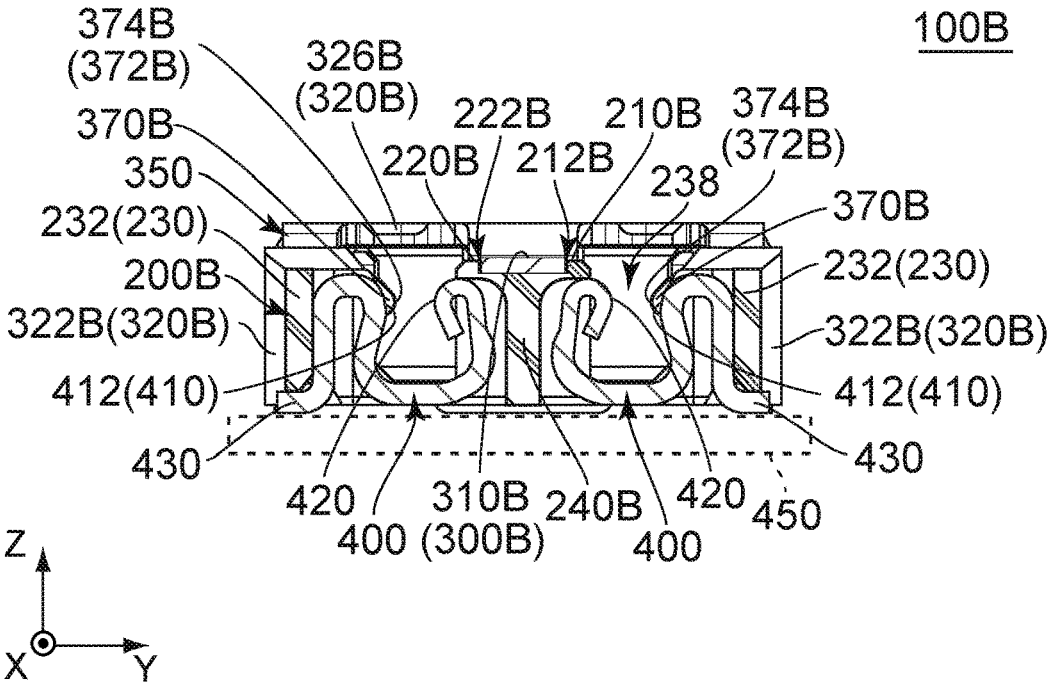
FIG. 32 is a cross-sectional view showing the second connector of FIG. 31, taken along line L-L. In the figure, the second circuit board is illustrated by dotted line.
Figure 33:
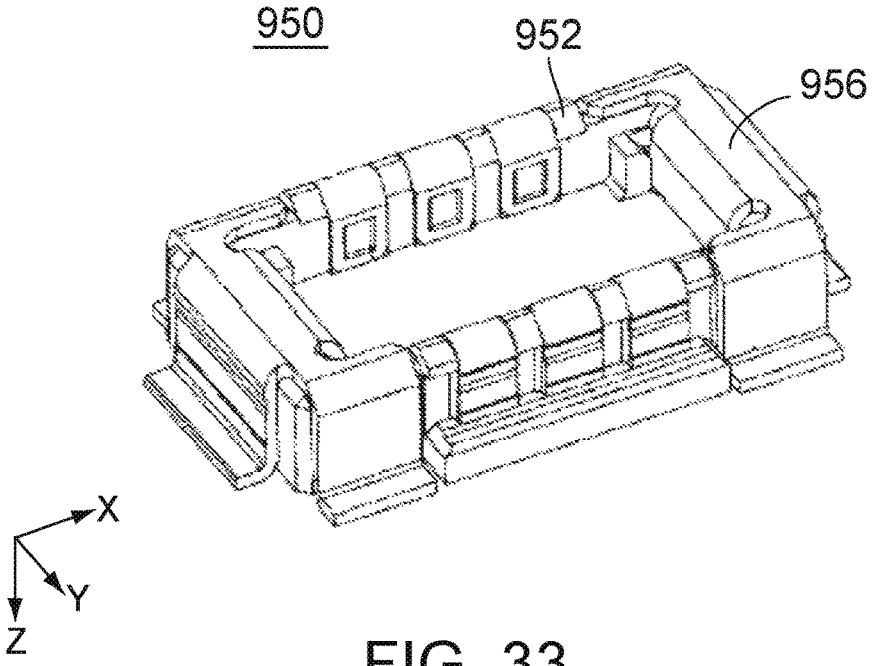
FIG. 33 PRIOR ART
FIG. 33 is a lower perspective view showing a first connector which is included in a connector assembly of Patent Document 1.
Figure 34:
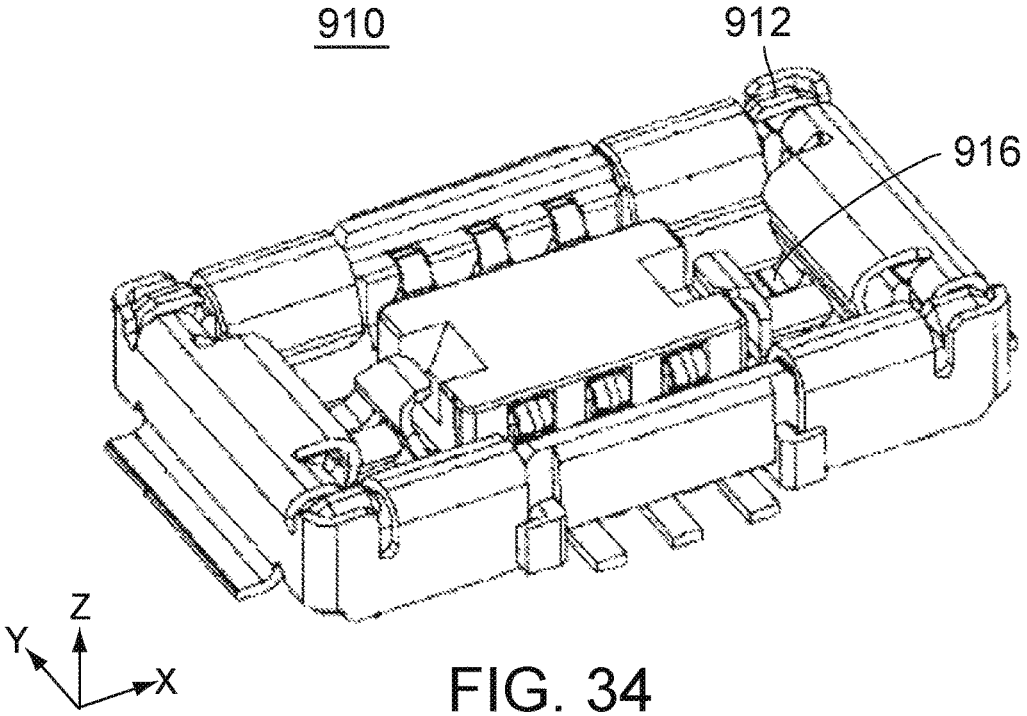
FIG. 34 PRIOR ART
FIG. 34 is an upper perspective view showing a second connector which is included in the connector assembly of Patent Document 1.

As shown in FIGS. 30 and 32, the island-like portion 240B of the present embodiment has two insulating planes 210B, 220B, two boundary portions 212B, 222B, two additional insulating planes 250, 260 and two boundary portions 252, 262. In other words, the second insulator 200B has the two insulating planes 210B, 220B and the two additional insulating planes 250, 260. However, the present invention is not limited thereto. The second insulator 200B may be modified, provided that the second insulator 200B has at least one insulating plane 210B, 220B.

As shown in FIGS. 30 and 32, each of the insulating planes 210B, 220B and the additional insulating planes 250, 260 is a plane perpendicular to the first direction, or to the up-down direction.

As shown in FIG. 32, the boundary portion 212B of the present embodiment is positioned at an inner end of the insulating plane 210B in the second direction. The boundary portion 222B of the present embodiment is positioned at an inner end of the insulating plane 220B in the second direction.

As shown in FIG. 30, the boundary portion 252 of the present embodiment is positioned at an inner end of the additional insulating plane 250 in the third direction. The boundary portion 262 of the present embodiment is positioned at an inner end of the additional insulating plane 260 in the third direction.

Referring to FIG. 30, the second metal member 300B of the present embodiment is made of metal. The second metal member 300B has a plate-like shape perpendicular to the first direction, or to the up-down direction. The second metal member 300B is held by the second insulator 200B. The second metal member 300B has a second metal plane 310B.

As shown in FIG. 32, the second metal plane 310B of the present embodiment is a plane perpendicular to the first direction, or to the up-down direction. The second metal plane 310B is arranged adjacent to any of the two insulating planes 210B, 220B in the second direction. Specifically, the second metal plane 310B is positioned between the two insulating planes 210B, 220B in the second direction. More specifically, the second metal plane 310B is positioned between the two boundary portions 212B, 222B in the second direction. The second metal plane 310B is positioned above any of the insulating planes 210B, 220B in the first direction, or in the up-down direction. However, the present invention is not limited thereto. The arrangement of the second metal plane 310 may be modified, provided that the second metal plane 310B is arranged adjacent to the at least one insulating plane 210B, 220B in the second direction perpendicular to the first direction, or to the up-down direction.

As shown in FIG. 30, the second metal plane 310B of the present embodiment is positioned between the two additional insulating planes 250, 260 in the third direction perpendicular to both the second direction and the first direction which is the up-down direction. More specifically, the second metal plane 310B is positioned between the two boundary portions 252, 262 in the third direction. As shown in FIG. 24, the second metal plane 310B is positioned above any of the additional insulating planes 250, 260 in the first direction, or in the up-down direction.

As shown in FIG. 29, when the second connector 100B is viewed along the first direction, or along the up-down direction, the second metal plane 310B is surrounded by the insulating planes 210B, 220B and the additional insulating planes 250, 260. More specifically, when the second connector 100B is viewed along the first direction, or along the up-down direction, the second metal plane 310B is surrounded by the boundary portions 212B, 222B and the boundary portions 252, 262.

Figure 22:
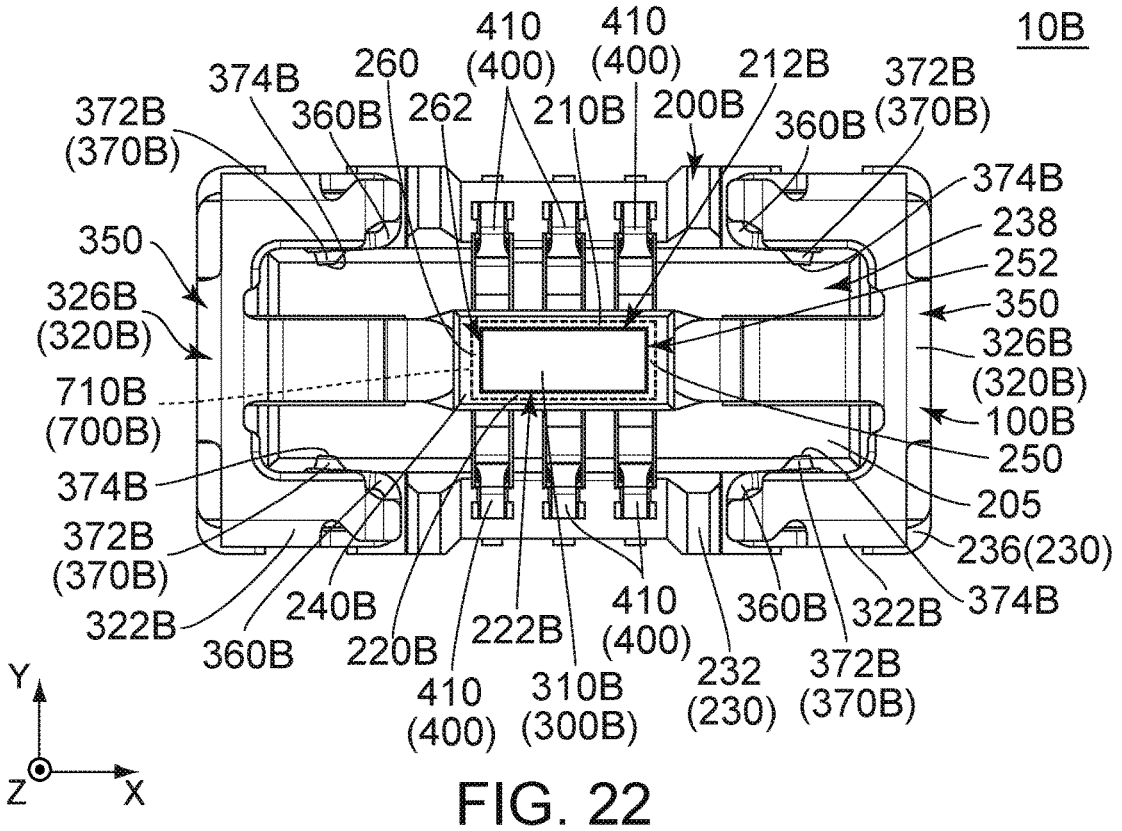
FIG. 22 is a top view showing the connector assembly of FIG. 21. Regarding a first connector, only an outline of a first metal member is illustrated by dotted line in the figure.

As shown in FIG. 22, in the second direction, the second metal plane 310B of the present embodiment has a dimension smaller than a dimension of the first metal plane 710B. In other words, in the second direction, the first metal plane 710B of the present embodiment has the dimension greater than the dimension of the second metal plane 310B.

As shown in FIG. 22, in the third direction, the second metal plane 310B of the present embodiment has a dimension equal to or less than a dimension of the first metal plane 710B. In other words, in the third direction, the first metal plane 710B of the present embodiment has the dimension equal to or greater than the dimension of the second metal plane 310B.

As shown in FIG. 28, each of the second additional metal members 350 has a main held portion 320B.

As shown in FIG. 28, the main held portion 320B of the present embodiment is held by the second peripheral portion 230 of the second insulator 200B. The main held portion 320B has first held portions 322B and a second held portion 326B.

As shown in FIG. 28, the first held portions 322B of the present embodiment are held by second longer walls 232, respectively, of the second peripheral portion 230 of the second insulator 200B. As shown in FIG. 30, each of the first held portions 322B has a resilient deformable portion 360B and a second additional member 370B.

As shown in FIG. 30, the resilient deformable portion 360B of the present embodiment extends outward in the third direction. An outer end of the resilient deformable portion 360B in the third direction is a free end. The resilient deformable portion 360B is resiliently deformable in the second direction.

As shown in FIG. 29, the second additional member 370B of the present embodiment is held by the second insulator 200B. The second additional member 370B protrudes inward in the second direction from the resilient deformable portion 360B. Since the resilient deformable portion 360B is resiliently deformable in the second direction as described above, the second additional member 370B is movable in the second direction. Under a state where the first connector 500B and the second connector 100B are not mated with each other, the second additional member 370B is positioned in the first peripheral portion accommodation portion 238. The second additional member 370B has a contact surface 372B. The contact surface 372B is a surface intersecting with both the second direction and the first direction which is the up-down direction. The contact surface 372B extends downward in the up-down direction and inward in the second direction from the resilient deformable portion 360B. The contact surface 372B has an inner end 374B. The inner end 374B is the innermost end of the contact surface 372B in the second direction.

As shown in FIGS. 28 to 30, the second held portion 326B of the present embodiment is held by the second shorter wall 236 of the second peripheral portion 230 of the second insulator 200B.

A further description will be made below about an operation of mating the first connector 500B with the second connector 100B of the connector assembly 10B of the present embodiment.

First, referring to FIGS. 21, 25 and 28, the first connector 500B and the second connector 100B are positioned so that the island-like portion accommodation portion 640B of the first insulator 600B of the first connector 500B faces the island-like portion 240B of the second insulator 200B of the second connector 100B in the up-down direction. Meanwhile, the first metal plane 710B of the first metal member 700B of the first connector 500B faces the second metal plane 310B of the second metal member 300B of the second connector 100B in the up-down direction.

After this positioning, the first connector 500B and the second connector 100B are moved to approach each other in the up-down direction, and then the first connector 500B is partially inserted into the second connector 100B in the up-down direction. Meanwhile, the first peripheral portion 620 of the first connector 500B is partially accommodated in the first peripheral portion accommodation portion 238 of the second connector 100B while the island-like portion 240B of the second insulator 200B of the second connector 100B is partially accommodated in the island-like portion accommodation portion 640B of the first insulator 600B of the first connector 500B.

When the first connector 500B and the second connector 100B are further moved to approach each other in the up-down direction, first inner contact portions 820 of the first terminals 800 of the first connector 500B are brought into contact with second inner contact portions 420 of the second terminals 400, respectively, of the second connector 100B in the up-down direction and thereby an insertion force of the first connector 500B into the second connector 100B is generated.

When a force is applied to the connector assembly 10B so that the first connector 500B and the second connector 100B are yet further moved approach each other in the up-down direction, a bent portion 844 of the first terminal 800 of the first connector 500B is moved downward relative to the second connector 100B while being in contact with a second outer contact portion 410 of the second terminal 400 corresponding thereto of the second connector 100B. Then, an upper end of the bent portion 844 is brought into contact with an inner end 412 of the second outer contact portion 410 of the second terminal 400 of the second connector 100B in the second direction. The insertion force of the first connector 500B into the second connector 100B is maximum at the time when the upper end of the bent portion 844 is brought into contact with the inner end 412.

After this contact, the force is further applied to the connector assembly 10B so that the first connector 500B and the second connector 100B are still further moved to approach each other. Then, a step portion 840 (see FIG. 12) of the first terminal 800 of the first connector 500B rides over the inner end 412 of the second outer contact portion 410 of the second terminal 400 corresponding thereto of the second connector 100B and is moved downward relative to the second connector 100B. Also, a first outer contact portion 810 of the first terminal 800 of the first connector 500B is brought into contact with the second outer contact portion 410 of the second terminal 400 corresponding thereto of the second connector 100B in the second direction. The insertion force of the first connector 500B into the second connector 100B is reduced after the step portion 840 of the first terminal 800 of the first connector 500B rides over the inner end 412 of the second outer contact portion 410 of the second terminal 400 corresponding thereto of the second connector 100B.

Specifically, upon the mating of the first connector 500B with the second connector 100B, a contact state between the first terminal 800 and the second terminal 400 is changed so that the insertion force of the first connector 500B into the second connector 100B is changed.

After that, the force is yet further applied to the connector assembly 10B so that the first connector 500B and the second connector 100B are still yet further moved to approach each other in the up-down direction. Then, the first metal plane 710B of the first metal member 700B of the first connector 500B abuts against the second metal plane 310B of the second metal member 300B of the second connector 100B. Meanwhile, the mating of the first connector 500B with the second connector 100B has been completed so that the first connector 500B and the second connector 100B are in a mated state where the first connector 500B and the second connector 100B are mated with each other. In other words, when the first connector 500B is mated with the second connector 100B, the first metal plane 710B of the first metal member 700B of the first connector 500B abuts against the second metal plane 310B of the second metal member 300B of the second connector 100B in the first direction, or in the up-down direction. When the first metal plane 710B abuts against the second metal plane 310B, a rather loud metallic sound is produced. Thus, an operator can easily and reliably recognize arrivals of the first connector 500B and the second connector 100B at their regular mating positions by hearing the metallic sound.

In other words, the connector assembly 10B of the present embodiment is configured as follows. Upon the mating of the first connector 500B with the second connector 100B, the first connector 500B is partially inserted into the second connector 100B in the first direction, or in the up-down direction. Upon the insertion of the first connector 500B into the second connector 100B, the first connector 500B abuts against the second metal plane 310B at the first metal plane 710B in the first direction, or in the up-down direction, after the first connector 500B is inserted into the second connector 100B in the first direction, or in the up-down direction, beyond a point at which the insertion force of the first connector 500B into the second connector 100B in the first direction, or in the up-down direction, is maximum. Upon the abutment of the first metal plane 710B against the second metal plane 310B, the mating of the first connector 500B with the second connector 100B has been completed.

Similar to the connector assembly 10 of the first embodiment, the connector assembly 10B has the aforementioned effect that an operator can recognize the completion of the mating of the first connector 500B with the second connector 100B by hearing the metallic sound. In particular, the aforementioned effect is especially beneficial when the connector assembly 10B of the present embodiment is used as a board-to-board connector assembly.

Referring to FIG. 22, under the mated state where the first connector 500B and the second connector 100B are mated with each other, the first metal plane 710B, at least in part, faces each of the second metal plane 310B and the two insulating planes 210B, 220B in the first direction, or in the up-down direction. However, the present invention is not limited thereto. The arrangement of the first metal plane 710B therefor may be modified, provided that the first metal plane 710B, at least in part, faces each of the second metal plane 310B and the at least one insulating plane 210B, 220B in the first direction, or in the up-down direction, under the mated state where the first connector 500B and the second connector 100B are mated with each other.

As shown in FIG. 24, under the mated state where the first connector 500B and the second connector 100B are mated with each other, the first metal plane 710B also faces each of the two additional insulating planes 250, 260 in the first direction, or in the up-down direction. However, the present invention is not limited thereto. The arrangement of the first metal plane 710B therefor may be modified, provided that the first metal plane 710B, at least in part, faces each of the two additional insulating planes 250, 260 in the first direction, or in the up-down direction, under the mated state where the first connector 500B and the second connector 100B are mated with each other.

Referring to FIG. 22, under the mated state where the first connector 500B and the second connector 100B are mated with each other, the first metal plane 710B traverses any of the boundary portion 212B, which is positioned between the second metal plane 310B and the insulating plane 210B in the second direction, and the boundary portion 222B positioned between the second metal plane 310B and the insulating plane 220B in the second direction. However, the present invention is not limited thereto. The position of the first metal plane 710B therefor may be modified, provided that the first metal plane 710B traverses a boundary portion 212B, 222B which is positioned between the second metal plane 310B and the at least one insulating plane 210B, 220B in the second direction.

As shown in FIG. 24, under the mated state where the first connector 500B and the second connector 100B are mated with each other, the first metal plane 710B traverses any of the boundary portion 252, which is positioned between the second metal plane 310B and the additional insulating plane 250 in the third direction, and the boundary portion 262 positioned between the second metal plane 310B and the additional insulating plane 260 in the third direction. However, the present invention is not limited thereto. The position of the first metal plane 710B therefor may be modified, provided that the first metal plane 710B traverses a boundary portion 252, 262 which is positioned between the second metal plane 310B and at least one additional insulating plane 250, 260 in the third direction.

Referring to FIGS. 22, 24 and 32, the connector assembly 10B of the present embodiment has a first distance from the first metal plane 710B to the insulating plane 210B in the first direction, or in the up-down direction, under the mated state. The connector assembly 10B of the present embodiment has a second distance from the first metal plane 710B to the insulating plane 220B in the first direction, or in the up-down direction, under the mated state. Under the mated state where the first connector 500B and the second connector 100B are mated with each other, a specific distance D4 from the first metal plane 710B to the second metal plane 310B in the first direction, or in the up-down direction, is shorter than any of the first distance and the second distance. However, the present invention is not limited thereto. The requirements for the specific distance D4 may be modified, provided that, under the mated state where the first connector 500B and the second connector 100B are mated with each other, the specific distance D4 from the first metal plane 710B to the second meta plane 310B in the first direction, or in the up-down direction, is shorter than a distance from the first metal plane 710B to the at least one insulating plane 210B, 220B in the first direction, or in the up-down direction.

As shown in FIG. 24, the connector assembly 10B of the present embodiment has a third distance D5 from the first metal plane 710B to the additional insulating plane 250 in the first direction, or in the up-down direction, under the mated state. The connector assembly 10B of the present embodiment has a fourth distance D6 from the first metal plane 710B to the additional insulating plane 260 in the first direction, or in the up-down direction, under the mated state. Under the mated state where the first connector 500B and the second connector 100B are mated with each other, the specific distance D4 from the first metal plane 710B to the second metal plane 310B in the first direction, or in the up-down direction, is shorter than any of the third distance D5 and the fourth distance D6.

Under the mated state where the first connector 500B and the second connector 100B are mated with each other, the first metal plane 710B and the second metal plane 310B may or may not be in contact with each other in the up-down direction. In other words, under the mated state where the first connector 500B and the second connector 100B are mated with each other, the first metal plane 710B and the second metal plane 310B may or may not be positioned apart from each other in the up-down direction. As shown in FIG. 24, the connector assembly 10B of the present embodiment is configured so that the first metal plane 710B and the second metal plane 310B are in contact with each other in the up-down direction under the mated state where the first connector 500B and the second connector 100B are mated with each other.

Figure 23:
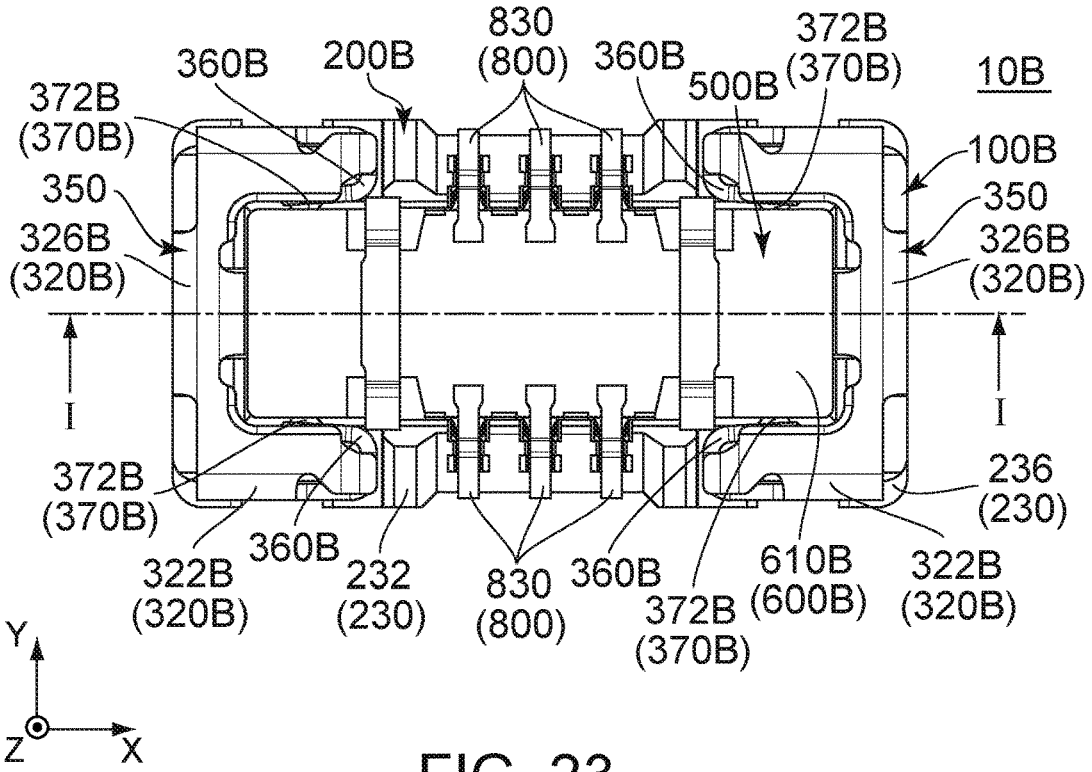
FIG. 23 is another top view showing the connector assembly of FIG. 21.

Referring to FIGS. 23, 25 and 32, under the mated state where the first connector 500B and the second connector 100B are mated with each other, the side surface portions 730B of the first additional members 770B of the first additional metal member 750 of the first connector 500B are in contact with the inner ends 374B of the contact surfaces 372B of the second additional members 370B, respectively, of the second additional metal member 350 corresponding thereto of the second connector 100B in the second direction while the first terminal 800 of the first connector 500B is in contact with the second terminal 400 corresponding thereto of the second connector 100B.

Although the specific explanation about the present invention is made above referring to the embodiments, the present invention is not limited thereto and is susceptible to various modifications and alternative forms.

Although the connector assembly 10, 10B of the present embodiment is configured so that the first connector 500, 500A, 500B is a plug while the second connector 100, 100B is a receptacle, the present invention is not limited thereto. The connector assembly 10, 10B may be configured so that the first connector 500, 500A, 500B is a receptacle while the second connector 100, 100B is a plug.

Although the connector assembly 10 of the present embodiment comprises two sets each consisting of the first metal plane 710, the second metal plane 310 and the two insulating planes 210, 220 while the connector assembly 10B of the present embodiment comprises a set consisting of the first metal plane 710B, the second metal plane 310B and the two insulating planes 210B, 220B, the present invention is not limited thereto. Specifically, the connector assembly 10, 10B may comprise two or more sets each consisting of the first metal plane 710, 710B, the second metal plane 310, 310B and the two insulating planes 210, 210B, 220, 220B.

Although the connector assembly 10, 10B of the present embodiment is configured so that the first connector 500, 500A, 500B comprises the first metal plane(s) 710, 710B while the second connector 100, 100B comprises the second metal plane(s) 310, 310B and the insulating planes 210, 210B, 220, 220B, the present invention is not limited thereto. The connector assembly 10, 10B may be configured so that the first connector 500, 500A, 500B comprises the second metal plane(s) 310, 310B and the insulating planes 210, 210B, 220, 220B while the second connector 100, 100B comprises the first metal plane(s) 710, 710B. If the connector assembly 10, 10B comprises two or more sets each consisting of the first metal plane 710, 710B, the second metal plane 310, 310B and the two insulating planes 210, 210B, 220, 220B, the connector assembly 10, 10B may be configured so that, in at least one of the two or more sets, the second metal plane 310, 310B and the two insulating planes 210, 210B, 220, 220B are provided to the first connector 500, 500A, 500B while the first metal plane 710, 710B is provided to the second connector 100, 100B.

Each of the first metal member 700, the second metal member 300, the first additional metal member 750 and the second additional metal member 350 of the connector assembly 10, 10B of the present embodiment is also usable as a terminal.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector and a second connector, wherein:

the first connector is mateable with and removable from the second connector along a first direction;

the first connector comprises a first insulator and a first metal member;

the first metal member is held by the first insulator;

the first metal member has a first metal plane;

the second connector comprises a second insulator and a second metal member;

the second insulator has at least one insulating plane;

the second metal member is held by the second insulator;

the second metal member has a second metal plane;

the second metal plane is arranged adjacent to the at least one insulating plane in a second direction perpendicular to the first direction;

the first metal plane, at least in part, faces each of the second metal plane and the at least one insulating plane in the first direction in a mated state in which the first connector and the second connector are mated with each other;

a distance from the first metal plane to the second metal plane in the first direction is shorter than a distance from the first metal plane to the at least one insulating plane in the first direction in the mated state;

the first metal plane is positioned above the second metal plane in the first direction in the mated state;

the second insulator has an island-like portion;

the second metal member further has an auxiliary held portion;

the auxiliary held portion extends inward in a third direction perpendicular to both the first direction and the second direction from a part of the second metal plane, the part of the second metal plane being an inner end of the second metal plane in the third direction;

the auxiliary held portion is held by the island-like portion; and an upper end of the island-like portion is positioned above an upper end of the auxiliary held portion in the first direction.

2. The connector assembly as recited in claim 1, wherein:

the at least one insulating plane includes two of the insulating planes;

the second metal plane is positioned between the two insulating planes in the second direction;

in the second direction, the first metal plane has a dimension greater than a dimension of the second metal plane;

the first metal plane, at least in part, faces each of the second metal plane and the two insulating planes in the first direction in the mated state;

the connector assembly has a first distance from the first metal plane to one of the insulating planes in the first direction in the mated state;

the connector assembly has a second distance from the first metal plane to a remaining one of the insulating planes in the first direction in the mated state; and the distance from the first metal plane to the second metal plane in the first direction is shorter than any of the first distance and the second distance in the mated state.

3. The connector assembly as recited in claim 2, wherein in the third direction, the first metal plane has a dimension smaller than a dimension of the second metal plane.

4. The connector assembly as recited in claim 1, wherein the first metal plane abuts against the second metal plane in the first direction when the first connector is mated with the second connector.

5. The connector assembly as recited in claim 4, wherein:

the first connector is partially inserted into the second connector in the first direction upon the mating of the first connector with the second connector;

upon the insertion of the first connector into the second connector, the first connector abuts against the second metal plane at the first metal plane in the first direction after the first connector is inserted into the second connector in the first direction beyond a point at which an insertion force of the first connector into the second connector in the first direction is maximum; and the mating of the first connector with the second connector has been completed upon the abutment of the first metal plane against the second metal plane.

6. The connector assembly as recited in claim 5, wherein:

the first connector comprises at least one first terminal;

the first insulator holds the at least one first terminal;

the second connector comprises at least one second terminal;

the second insulator holds the at least one second terminal; and upon the mating of the first connector with the second connector, a contact state between the first terminal and the second terminal is changed so that the insertion force is changed.

7. The connector assembly as recited in claim 5, wherein:

the first connector comprises at least one first terminal and at least one first additional member;

the first insulator holds the at least one first terminal and the at least one first additional member;

the second connector comprises at least one second terminal and at least one second additional member;

the second insulator holds the at least one second terminal and the at least one second additional member; and upon the mating of the first connector with the second connector, a contact state between the first additional member and the second additional member is changed so that the insertion force is changed.

8. The connector assembly as recited in claim 7, wherein:

the first metal member has the first additional member; and the second metal member has the second additional member.

9. The connector assembly as recited in claim 1, wherein:

the first connector is fixed on a first circuit board when used;

the second connector is fixed on a second circuit board when used; and the second circuit board is different from the first circuit board.

10. A connector assembly comprising a first connector and a second connector, wherein:

the first connector is mateable with and removable from the second connector along a first direction;

the first connector comprises a first insulator and a first metal member;

the first metal member is held by the first insulator;

the first metal member has a first metal plane;

the second connector comprises a second insulator and a second metal member;

the second insulator has at least one insulating plane;

the second metal member is held by the second insulator;

the second metal member has a second metal plane;

the second metal plane is arranged adjacent to the at least one insulating plane in a second direction perpendicular to the first direction;

the first metal plane, at least in part, faces each of the second metal plane and the at least one insulating plane in the first direction in a mated state in which the first connector and the second connector are mated with each other;

a distance from the first metal plane to the second metal plane in the first direction is shorter than a distance from the first metal plane to the at least one insulating plane in the first direction in the mated state;

the first metal plane is positioned above the second metal plane in the first direction in the mated state;

the second insulator has a bottom surface portion and an island-like portion;

the bottom surface portion has a plate-like shape perpendicular to the first direction;

the bottom surface portion defines a lower end of the second insulator;

the island-like portion protrudes upward from the bottom surface portion;

the second metal plane is positioned in the vicinity of an upper end of the island-like portion;

the at least one insulating plane includes two of the insulating planes;

the second metal plane is positioned between the two insulating planes in the second direction;

in the second direction, the first metal plane has a dimension greater than a dimension of the second metal plane;

the first metal plane, at least in part, faces each of the second metal plane and the two insulating planes in the first direction in the mated state;

the connector assembly has a first distance from the first metal plane to one of the insulating planes in the first direction in the mated state;

the connector assembly has a second distance from the first metal plane to a remaining one of the insulating planes in the first direction in the mated state; and the distance from the first metal plane to the second metal plane in the first direction is shorter than any of the first distance and the second distance in the mated state.

11. The connector assembly as recited in claim 10, wherein:

the second insulator further has two additional insulating planes;

the second metal plane is positioned between the two additional insulating planes in a third direction perpendicular to both the first direction and the second direction;

when the second connector is viewed along the first direction, the second metal plane is surrounded by the insulating planes and the additional insulating planes;

in the third direction, the first metal plane has a dimension equal to or greater than a dimension of the second metal plane;

the first metal plane, at least in part, faces each of the two additional insulating planes in the first direction in the mated state;

the connector assembly has a third distance from the first metal plane to one of the additional insulating planes in the first direction in the mated state;

the connector assembly has a fourth distance from the first metal plane to a remaining one of the additional insulating planes in the first direction in the mated state; and the distance from the first metal plane to the second metal plane in the first direction is smaller than any of the third distance and the fourth distance in the mated state.

12. The connector assembly as recited in claim 10, wherein the first metal plane abuts against the second metal plane in the first direction when the first connector is mated with the second connector.

13. The connector assembly as recited in claim 12, wherein:

the first connector is partially inserted into the second connector in the first direction upon the mating of the first connector with the second connector;

upon the insertion of the first connector into the second connector, the first connector abuts against the second metal plane at the first metal plane in the first direction after the first connector is inserted into the second connector in the first direction beyond a point at which an insertion force of the first connector into the second connector in the first direction is maximum; and the mating of the first connector with the second connector has been completed upon the abutment of the first metal plane against the second metal plane.

14. The connector assembly as recited in claim 13, wherein:

the first connector comprises at least one first terminal;

the first insulator holds the at least one first terminal;

the second connector comprises at least one second terminal;

the second insulator holds the at least one second terminal; and upon the mating of the first connector with the second connector, a contact state between the first terminal and the second terminal is changed so that the insertion force is changed.

15. The connector assembly as recited in claim 13, wherein:

the first connector comprises at least one first terminal and at least one first additional member;

the first insulator holds the at least one first terminal and the at least one first additional member;

the second connector comprises at least one second terminal and at least one second additional member;

the second insulator holds the at least one second terminal and the at least one second additional member; and upon the mating of the first connector with the second connector, a contact state between the first additional member and the second additional member is changed so that the insertion force is changed.

16. The connector assembly as recited in claim 15, wherein:

the first metal member has the first additional member; and the second metal member has the second additional member.

17. The connector assembly as recited in claim 10, wherein:

the first connector is fixed on a first circuit board when used;

the second connector is fixed on a second circuit board when used; and the second circuit board is different from the first circuit board.

* * * * *